US007997192B2

(12) United States Patent
Billet et al.

(10) Patent No.: US 7,997,192 B2
(45) Date of Patent: Aug. 16, 2011

(54) PRINTING MACHINE

(75) Inventors: Maurice Billet, Chambourcy (FR); Gérard Platel, Saint Maure des Fosses (FR); Vincent Baillon, Cormeilles en Parisis (FR); Fabien Gavet, Cormeilles en Parisis (FR)

(73) Assignee: Machines Dubuit, Noisy-le-Grand (FR)

( * ) Notice: Subject to any disclaimer, the term of this patent is extended or adjusted under 35 U.S.C. 154(b) by 1099 days.

(21) Appl. No.: 11/761,511

(22) Filed: Jun. 12, 2007

(65) Prior Publication Data

US 2007/0289458 A1 Dec. 20, 2007

(30) Foreign Application Priority Data

Jun. 12, 2006 (FR) ..... 06 05207

(51) Int. Cl.
*B41F 17/18* (2006.01)

(52) U.S. Cl. ..... 101/37; 101/40.1; 101/41; 101/44

(58) Field of Classification Search ..... 101/38.1, 101/37, 40.1, 41, 40, 43, 44, 297
See application file for complete search history.

(56) References Cited

U.S. PATENT DOCUMENTS

| | | | | |
|---|---|---|---|---|
| 3,159,100 | A | 12/1964 | Marquiss | |
| 4,048,914 | A * | 9/1977 | Kammann et al. | 101/35 |
| 4,122,768 | A * | 10/1978 | Dubuit et al. | 101/39 |
| 4,164,279 | A | 8/1979 | Dubuit | |
| 4,352,326 | A | 10/1982 | Kammann | |
| 4,862,798 | A | 9/1989 | Motev | |
| 5,076,165 | A * | 12/1991 | Pollich | 101/409 |
| 5,207,156 | A | 5/1993 | Helling | |
| 5,471,924 | A * | 12/1995 | Helling | 101/38.1 |
| 5,651,308 | A * | 7/1997 | Rohwetter et al. | 101/40.1 |
| 5,682,816 | A * | 11/1997 | van der Griendt et al. | 101/37 |

FOREIGN PATENT DOCUMENTS

| | | |
|---|---|---|
| DE | 3740457 | 6/1989 |
| FR | 2367610 | 5/1978 |
| FR | 2463003 | 2/1981 |

* cited by examiner

*Primary Examiner* — James R Bidwell

(74) *Attorney, Agent, or Firm* — Young & Thompson

(57) ABSTRACT

A printing machine includes a conveyor for at least one item to be printed, a print station and a transfer device including at least one bucket for conveying the item and an element for driving the conveyor bucket, which element is capable of displacing the conveyor bucket between a position for taking up or depositing the item on the conveyor and a position for taking up or depositing the item at the print station. The transfer device further includes an element for adjusting the path of displacement of the conveyor bucket, which element is capable of controlling the drive element in order to displace the position for taking up or depositing the item at the print station without displacing the position for taking up or depositing the item on the conveyor.

31 Claims, 16 Drawing Sheets

PRINTING MACHINE

TECHNICAL FIELD

The present invention relates to a printing machine of the type comprising:

a frame:

at least one conveyor capable of conveying at least one item to be printed;

at least one print station fixed relative to the frame and capable of printing a pattern on the item to be printed; and at least one transfer device comprising a base fixed relative to the frame and comprising at least one bucket for conveying the item to be printed and means for driving the conveyor bucket, which means are capable of displacing said conveyor bucket between a position for taking up or depositing the item on the conveyor and a position for taking up or depositing the item at the print station.

In particular, the invention relates to a machine for printing items having a cylindrical or elliptical cross-section.

BACKGROUND TO THE INVENTION

Known, in particular, from document FR 2 639 874 is a printing machine comprising a transfer device capable of displacing an item to be printed from a conveyor for supplying the item to a print station device for holding the item.

This transfer device comprises a vacuum sucker mounted on an oscillating arm capable of causing the item to be printed to pivot from a position in which its axis of revolution is horizontal to a position in which its axis of revolution is vertical. During printing, the item is kept in this vertical position by the holding device. The printing screen and the doctor blades are displaced in two perpendicular directions for printing the item.

However, the device for displacing the screen and the doctor blades is mechanically complex. Moreover, this type of printing machine has low printing rates. Furthermore, the transfer device used in this machine cannot be used in printing machines comprising a plurality of print and drying stations.

Also known, in particular from document FR 2 367 610, is a printing machine comprising a device for transferring an item between a supply conveyor and a holding device. The transfer device comprises a crank lever carried by a shaft, parallel to the axis for the take-up of the item. In its median zone, the lever carries a roller by means of which it is subjected, for the control during pivoting thereof, to a rotary cam engaged with a guide track.

In this printing machine, the screen and the doctor blades are not displaced around the item; instead, the item is displaced along a circle having a radius equal to the radius of the elliptical cross-section of the item.

However, the position for taking up the item on the supply conveyor depends on the radius of the elliptical item. Accordingly the relative position between the print station and the conveyor for supplying the item has to be modified each time the printing station is used to print an item having a differing shape or size.

Similarly, when a transfer device of this type is used for displacing a printed item between the print station and a conveyor for discharging the item, the relative position between the print station and the discharge conveyor has to be modified each time the printing machine is used to print an item of differing size or shape.

The object of the invention is to provide a printing machine which is of simple construction and easily adjustable, in particular without relative displacement of the supply and discharge conveyors, when series of items of differing size and shape have to be printed.

SUMMARY OF THE INVENTION

For this purpose, the invention relates to a printing machine of the aforementioned type, characterised in that the transfer device further comprises means for adjusting the path of displacement of the conveyor bucket, which means are capable of adjusting the drive means in order to displace the position for taking up or depositing the item on the print station without displacing the position for taking up or depositing the item on the conveyor.

According to particular embodiments, the printing machine has one or more of the following features:

the drive means comprise:

a drive plate capable of being driven in rotation;

a slide capable of displacing the conveyor bucket relative to the base; and a link for coupling the drive plate to the slide, said link being displaceable relative to the drive plate;

the drive plate is capable of being driven in rotation about a shaft fixed relative to the base and the adjustment means are capable of modifying the distance between the shaft and the link to adjust the path of displacement of the conveyor bucket;

the adjustment means are capable of allowing uncoupling of the slide relative to the drive plate during displacement of the coupling link relative to the plate along a unique predefined trajectory and only when the conveyor bucket is in the position for taking up or depositing the item on the conveyor;

the adjustment means comprise an adjustment groove integral with the drive plate and the coupling link comprises:

a first end engaged with the adjustment groove, said first end of the link being capable of being displaced along the adjustment groove and of being immobilised at a point of the adjustment groove to adjust the path of displacement of the conveyor bucket; and a second end carried by the slide, the second end being capable of being displaced relative to the slide during displacement of the first end of the link along the adjustment groove without displacement of the conveyor bucket when the conveyor bucket is in the position for taking up or depositing the item on the conveyor;

the adjustment groove is rectilinear;

the coupling link comprises a sliding connection between the slide and the drive plate, said sliding connection extending parallel to the adjustment groove when the conveyor bucket is in the position for taking up or depositing the item on the conveyor;

said sliding connection extends perpendicularly to the adjustment groove when the conveyor bucket is in the position for taking up or depositing the item on the print station;

the sliding connection comprises a cam track integral with the slide and a roller capable of sliding in said cam track, the shaft of the roller being connected to an end of the coupling link;

the drive plate is capable of driving the slide by pressing the roller against a support face of the cam track, the link being displaced in the cam track during displacement of the drive plate;

the slide comprises a first slide extending along a first axis and a second slide extending along a second axis perpendicular to the first axis;

the coupling link comprises a first link for coupling the drive plate to the first slide and a second link for coupling the drive plate to the second slide, the second coupling link being identical to the first coupling link;

the adjustment means comprise a first adjustment groove and a second adjustment groove formed in the drive plate;

the first adjustment groove extends along the first axis when the conveyor bucket is in the position for taking up or depositing the item on the print station and along the second axis when the conveyor bucket is in the position for taking up or depositing the item on the conveyor;

the second adjustment groove is perpendicular to the first adjustment groove;

the second slide comprises at least one rail mounted so as to be fixed relative to the base, the rail being parallel to the second axis, and a second carriage capable of sliding over the or each fixed rail;

the first slide comprises at least one movable rail which is integral with the second carriage, the or each movable rail extending along the first axis, and a first carriage guided on the movable rail;

the adjustment groove extends in an arc of a circle and the second end of the link comprises a pivot which is centred on the adjustment groove when the conveyor bucket is in the position for taking up or depositing the item on the conveyor;

the drive means comprise a linkage having an adjustable configuration comprising at least four articulation points and the adjustment means are capable of displacing at least a first articulation point of the linkage, the first articulation point being capable of being displaced, in order to produce said adjustment, along an arc of a circle centred on a second articulation point only in the position for taking or depositing the item on the conveyor;

the linkage comprises at least a first connecting rod connected to the drive plate; and the adjustment means comprise at least a first means for articulating an end of the first connecting rod to a slideway of the drive plate, which means is capable of adjusting the path of displacement of the conveyor bucket in a first adjustment direction;

the first articulation means is adjustable in the position for taking up or depositing the item on the conveyor whereas the conveyor bucket is not displaced during this adjustment;

the first articulation means comprises:

a first groove in the form of an arc of a circle centred on said articulation point when the transfer device is in a position for taking up or depositing the item at the conveyor and a first roller capable of being guided in the first groove;

the linkage further comprises a second connecting rod connected to the drive plate; and the adjustment means comprise a second means for articulating an end of the second connecting rod to a slideway of the drive plate, which means is capable of adjusting the path of displacement of the conveyor bucket in a second adjustment direction differing from said first adjustment direction;

said second adjustment direction is perpendicular to the first adjustment direction;

the second articulation means is adjustable in the position for taking up or depositing the item at the transporter whereas the conveyor bucket is not displaced during this adjustment;

the second articulation means comprises:

a second groove in the form of an arc of a circle centred on the second articulation point when the transfer device is in a position for taking up or depositing the item at the conveyor and a second roller capable of being guided in the second groove;

the linkage forms a quadrilateral comprising at least a first side, the length of which can be adjusted by said adjustment means;

the quadrilateral comprises at least a second side, the length of which can be adjusted by said adjustment means;

a first apex of the quadrilateral comprises a first slide guided on a first rail fixed relative to the frame and extending in first adjustment direction;

a second apex of the quadrilateral comprises a second slide which carries the conveyor bucket and is capable of being guided in a movable rail integral with the first slide and extending in said second adjustment direction;

the conveyor is a conveyor for conveying at least one item to be printed, the conveyor bucket being a bucket for supplying the item to be printed, the drive means being means for driving the supply bucket, which means are capable of displacing said supply bucket between a position for taking up the item on the supply conveyor and a position for depositing the item at the print station, the adjustment means being means for adjusting the path of displacement of the supply bucket;

the machine further comprises a conveyor for discharging the item after printing;

the transfer device further comprises:

a bucket for discharging the printed item;

means for driving the discharge bucket, which means are capable of displacing said discharge bucket between a position for taking up the printed item at the print station and a position for depositing the printed item on the discharge conveyor;

means for adjusting the path of displacement of the discharge bucket:

the means for adjusting the path of the supply bucket and the means for adjusting the path of the discharge bucket are independent of one another;

the means for driving the supply bucket and the means for driving the discharge bucket are arranged symmetrically relative to a median plane D-D intersecting the print station;

the transfer device comprises synchronisation means capable of synchronising the displacement of the supply bucket and the displacement of the discharge bucket;

the item to be printed comprises an axis of revolution, and the drive means are capable of displacing the conveyor bucket which is fixed in rotation relative to its axis of revolution;

the print station comprises:

a) a screen supporting a mesh carrying a pattern to be printed on the item, the screen being capable of being displaced only in a predefined plane, b) at least one doctor blade which is arranged in line with the mesh of the screen and is capable of being displaced only in a plane perpendicular to the predefined plane of displacement of the screen, and c) device for holding and driving the item arranged in line with the mesh of the screen in such a way that, during printing, the mesh is clamped between the item and the or each doctor blade, the holding and drive device being capable of driving the item in rotation between the position for taking up the item on the supply bucket and the position for depositing the item on the discharge bucket;

the conveyor comprises a housing mounted so as to be fixed relative to the frame.

BRIEF DESCRIPTION OF THE DRAWINGS

The invention will be better understood on reading the following description given merely by way of example and with reference to the drawings, in which.

DESCRIPTION OF PREFERRED EMBODIMENTS

Figure 1:
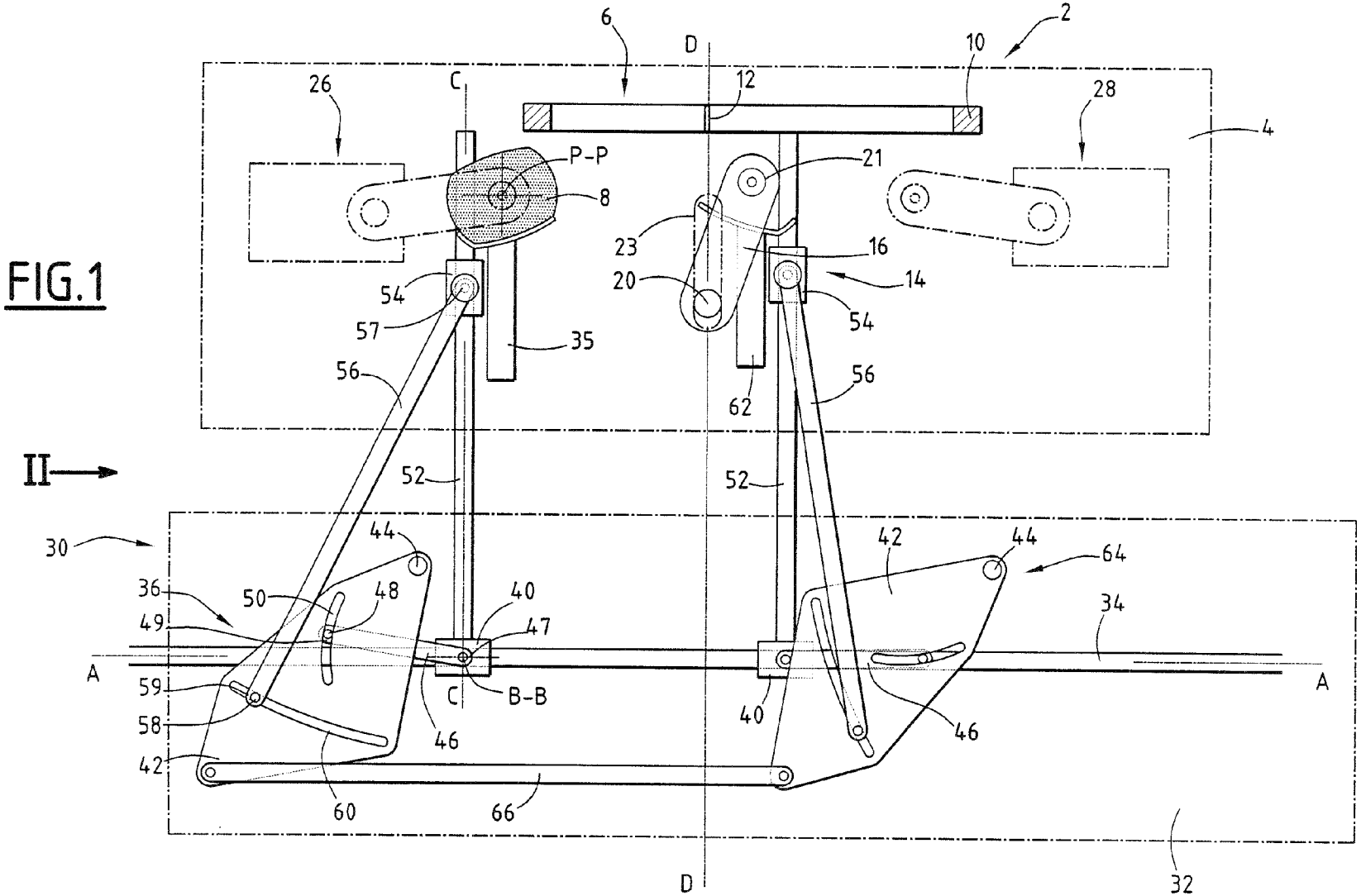
FIG. 1 is a schematic front view of a portion of the printing machine according to a first embodiment of the invention in a position for take-up of the item by the device for transferring the item to a supply conveyor.

The printing machine 2 according to the first embodiment of the invention comprises a frame 4 shown merely by a portion of its front face and a print station 6 fixed to the frame 4.

The print station 6 is capable of printing an item 8 having a central axis for revolution of the item and an elliptical or cylindrical cross-section.

The print station 6 comprises a screen holder (not shown) carried by the frame 4 and supporting a screen 10, a doctor blade holder (not shown) carried by the frame 4 in line with the screen 10 and supporting a doctor blade 12 and a device 14 for holding and driving the item during printing. The holding and drive device 14 is fixed to the frame 4 in line with the screen 10 on the side of the screen remote from the side containing the doctor blade 12.

Figure 7:
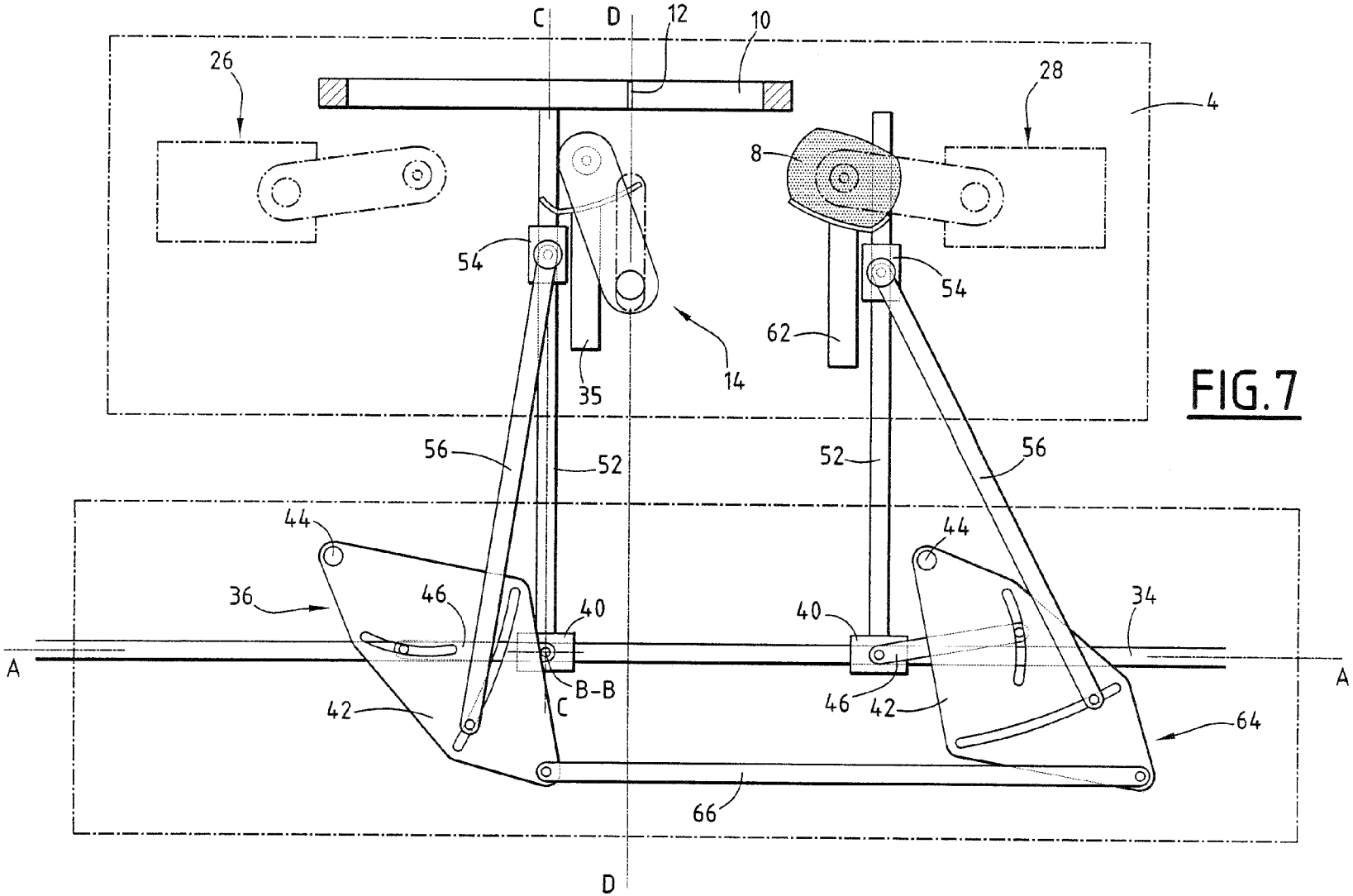
FIG. 7 is a view similar to the view of FIG. 1 in a position in which the transfer device deposits the item at the discharge conveyor.

The screen 10 is mounted in slideways of the screen holder. It is capable of being displaced by drive means (not shown) in a back-and-forth movement in a plane parallel to the large face of the screen between a pre-printing position shown in FIG. 1, 2, 3 and a post-printing position shown in FIG. 7. The screen 10 is translationally fixed in a direction perpendicular to the large face of the screen.

The screen 10 consists of a framework on which there is fixed a mesh carrying a pattern to be printed on the item.

The doctor blade 12 is mounted so as to be movable over a plane perpendicular to the plane of displacement of the screen between a printing position in which the doctor blade 12 is in contact with the mesh of the screen and a position in which the doctor blade 12 is set apart from the mesh of the screen.

The holding and drive device 14 comprises two arms 16, 18 fixed, facing each other, to a drive shaft 20 extending perpendicularly to the front face of the frame 4.

At one of its ends, one of the arms 16, 18 is equipped with a cap 21 delimiting an imprint having a shape complementary to the shape of the bottom of the item 8 to be printed and the other with a tip 22 for holding the neck of the item arranged facing the cap 21. The cap 21 and the tip 22 are capable of taking up the item and for clamping it along a take-up axis corresponding to the axis of revolution P-P of the item.

The tip 22 can be slid towards and away from the front face of the frame 4 in order axially to clamp items 8 of differing length between the cap 21 and the tip 22.

The drive shaft 20 is driven in rotation about its axis in order to displace the item held between the cap 21 and the tip 22 along an arc of a circle centred on the axis of the drive shaft.

The drive shaft 20 is carried by a slide 23 fixed to the frame 4 in order to displace the cap 21 and the tip 22 towards and away from the screen 10 to adjust the distance between the item 8 and the screen 10 as a function of the size of the item.

The print station 6 further comprises control means (not shown) capable of synchronising the translational movements of the screen 10 with the rotational movement of the drive shaft 20 and the translational movement of the doctor blade 12, staggered in time relative to the movements of the screen 10 and the drive shaft 20.

The printing machine 2 further comprises a conveyor 26 for supplying the item to be printed, which conveyor is arranged upstream of the print station 6 in the direction of displacement of the item during printing, a conveyor 28 for discharging the item arranged downstream of the print station 6 and a transfer device 30 capable of displacing the item 8 from the supply conveyor 26 to the print station 6 and from the print station 6 to the discharge conveyor 28.

In the described embodiment, the supply conveyor 26 and the discharge conveyor 28 consist of a single device which is carried by the frame 4 and is similar to the holding and drive device 14 and will therefore not be redescribed.

The transfer device 30 comprises a base 32 which is illustrated schematically and is fixed relative to the frame 4 and a rail 34 which is fixed to the base 32 and extends along an axis A-A in a plane parallel to the plane of displacement of the screen 10 and perpendicular to the front face of the printing machine. The axis A-A forms a first adjustment direction as specified in the remainder of the description.

The transfer device 30 further comprises a bucket 35 for conveying the item 8 to be printed, supply device 36 carrying the supply bucket 35 and mounted so as to be movable in translation along the axis A-A.

The conveyor bucket 35, referred to hereinafter as the supply bucket 35, is equipped with a suction nozzle (not shown) connected to a source of suction for holding the item in position during displacement thereof.

The movable device 36 comprises a slide 40 guided in translation over the fixed rail 34, a drive plate 42 mounted so as to rotate about a shaft 44 which is integral with the base 32 and extends along an axis B-B, perpendicular to the axis A-A and parallel to the take-up axis P-P, and a connecting rod 46 articulated at 47 by one of its ends to the slide 40 and comprising at its other end a pivot roller 48.

The drive plate 42 is driven in rotation about the shaft 44 by drive means (not shown).

The pivot roller 48 is articulated at 49 along an axis parallel to the axis B-B and is guided in a groove 50 formed in the drive plate 42. The groove 50 is in the form of an arc of a circle centred on the axis 47 for articulation of the connecting rod 46 to the slide 40 when the supply device 36 is in an end-of-travel position corresponding to what is known as a take-up position for the item at the supply conveyor 26.

The pivot roller 48 and the groove 50 form means for adjusting the path of displacement and the position for depositing the item at the print station of the supply bucket 35.

The movable device 36 further comprises a movable rail 52 which extends along an axis C-C perpendicular to the axis A-A and to the axis B-B and of which one end is fixed to the slide 40, a slide 54 carrying the supply bucket 35 and guided in the movable rail 52, and a connecting rod 56 articulated at 57 by one of its ends to the slide 54 and comprising a pivot roller 58 at its other end. The axis C-C forms a second adjustment direction as specified in the remainder of the description.

The pivot roller 58 is articulated at 59 along an axis parallel to the axis B-B and is guided in a groove 60 formed in the drive plate 42. The groove 60 is in the form of an arc of a circle centred on the axis 57 for articulation of the slide 54 to the connecting rod 56 when the supply device 36 is in the position for taking up the item at the supply conveyor 26.

The pivot roller 58 and the groove 60 form means for adjusting the path of displacement and the position for depositing the item at the print station of the supply bucket 35.

The drive plate 42, the connecting rods 46, 56 and the movable rail 52 form a linkage of adjustable configuration comprising four articulation points 47, 48, 57, 58. Two articulation points 48, 58 of this linkage are capable of being displaced to adjust the path of displacement of the supply bucket 35, as specified in the remainder of the description.

In the described embodiment, the linkage forms a quadrilateral.

During displacement of the pivot roller 48 and the pivot roller 58 in the groove 50 and in the groove 60 respectively, the length of the side formed by a portion of the plate 42 located between the articulation points 48 and 58 is modified, as is the length of the side 52 formed by the movable rail.

The transfer device 30 further comprises a second conveyor bucket, referred to hereinafter as the bucket 62 for discharging the printed item 8, and a discharge device 64 which carries the discharge bucket 62 and is mounted so as to be movable in translation over the fixed rail 34.

The discharge device 64 is similar to the supply device 36. It comprises like parts denoted by like reference numerals. It is mounted symmetrically to the supply device 36 relative to a plane D-D which is perpendicular to the front face of the printing machine 2 and in which the axes B-B and C-C are inscribed. The supply device 36 and the discharge device 64 are thus mounted so as to oppose each other.

A bar 66 connects the drive plate 42 of the supply device 36 to the drive plate 42 of the discharge device 64 to synchronise the movements of the supply bucket 35 and the discharge bucket 62.

The control means are also capable of synchronising the movements of the devices 35 and 64 with the movements of the screen 10, the drive shaft 20 and the doctor blade 12.

Initially, the item 8 to be printed is positioned on the supply conveyor 26.

Figure 2:
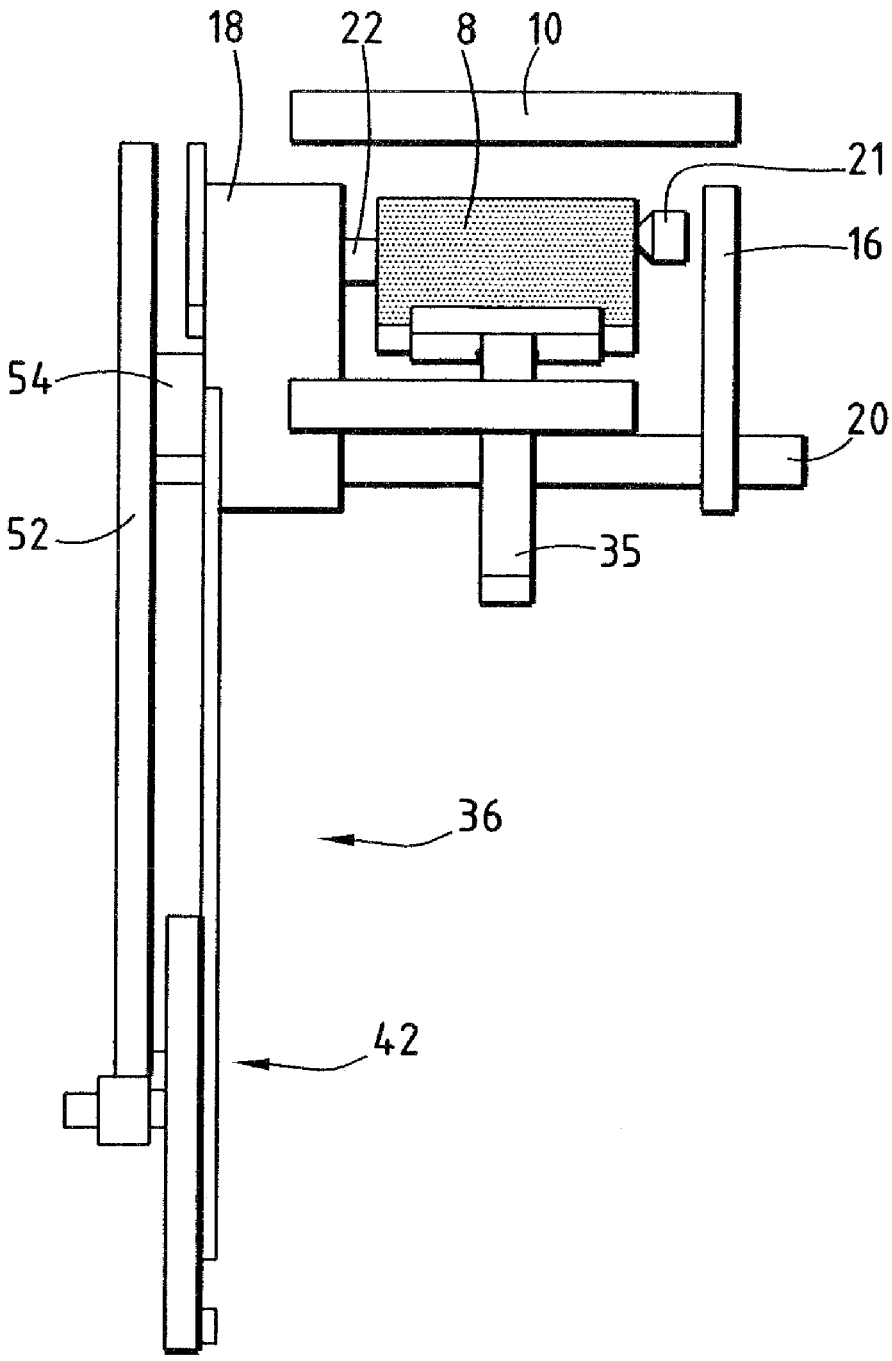
FIG. 2 is a schematic side view of a portion of the printing machine according to the first embodiment of the invention in a position similar to the position of FIG. 1.
Figure 3:
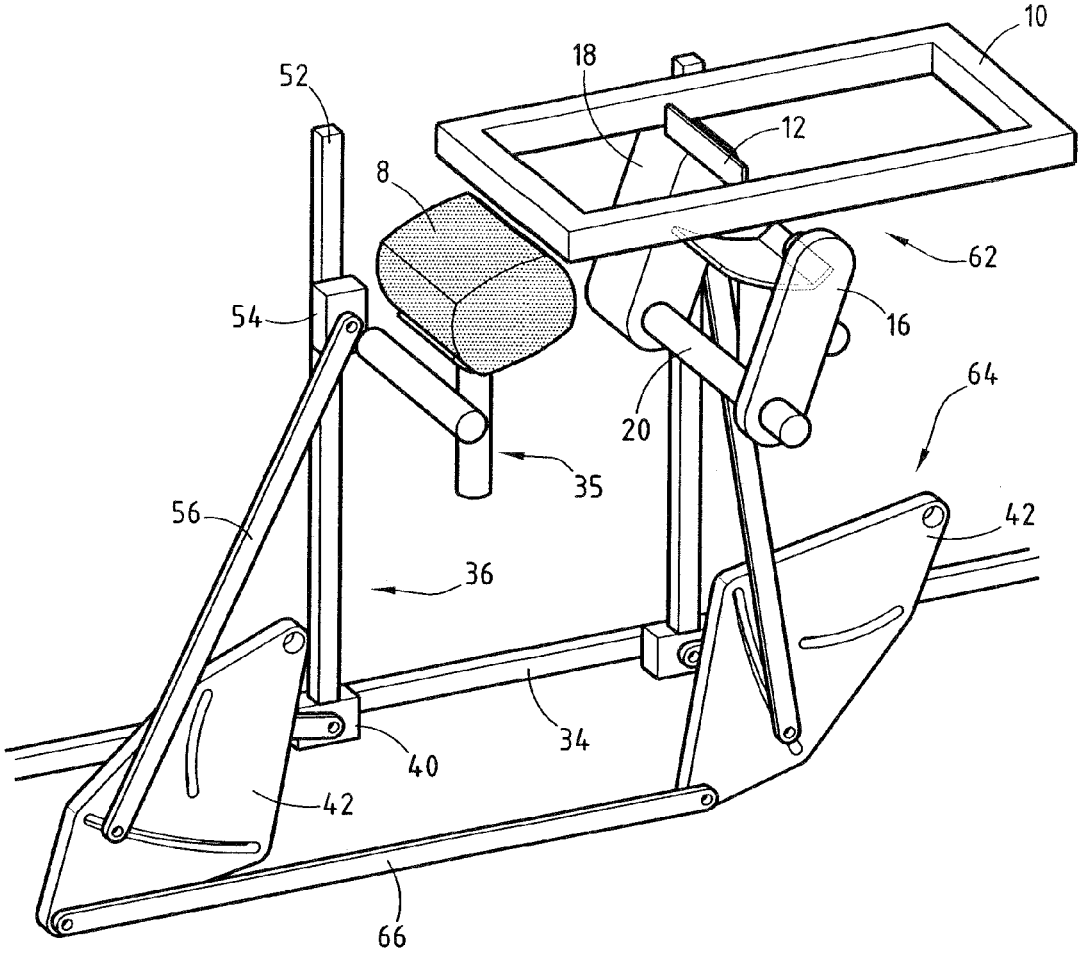
FIG. 3 is a schematic perspective view of a portion of the printing machine according to the first embodiment of the invention in a position similar to the position illustrated in FIG. 1.

The transfer device 30 is then in a position for taking up the item at the supply conveyor 26, as illustrated in FIGS. 1, 2 and 3.

Then, during a first phase for transferring an item, the drive plates 42 are driven so as to rotate anticlockwise about shafts 44.

The rotational movement of the drive plate 42 of the supply device 36 is transmitted to the slide 54 via the connecting rod 56 in such a way that the slide 54 moves back and forth along the movable rail 52 in order to withdraw the item 8 to be printed then move it towards the screen 10.

At the same time, the drive plate 42 drives the slide 40 in translation along the fixed rail 34. The simultaneous movements of the slide 54 and the slide 40 drive the supply bucket 35 in a movement in an arc of a circle. During this movement, the pivot rollers 48, 58 are engaged with the grooves 50, 60 at a single point of the groove and are not displaced within said groove.

During this transfer phase, the discharge device 64 is displaced in the same movement as the supply device 36 to convey a previously printed item (not shown in the figures).

Figure 4:
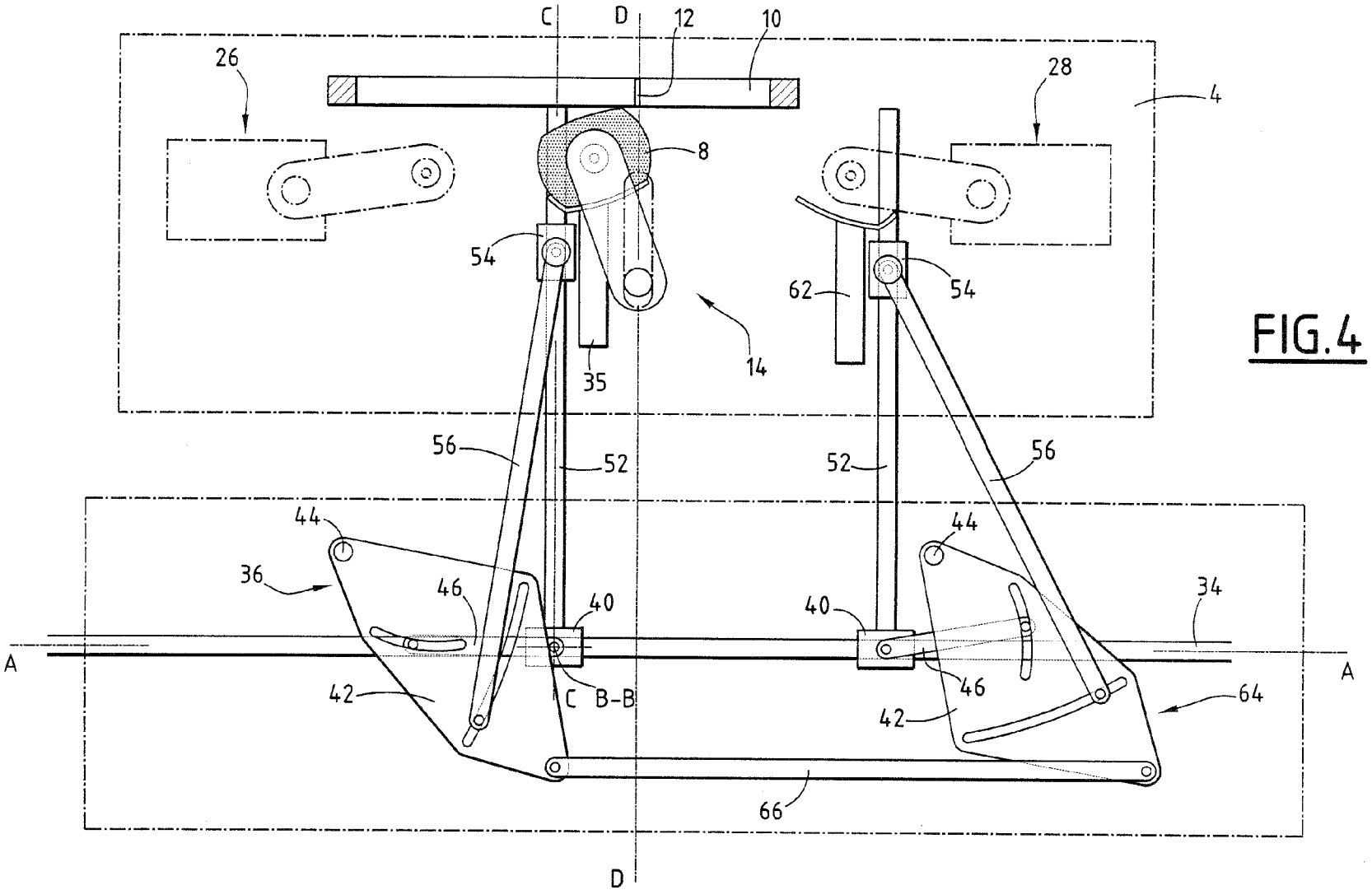
FIG. 4 is a view similar to the view of FIG. 1 in a position in which the transfer device deposits the item at the print station.

Once the movable device 36 has reached the end of its path, the item 8 to be printed is to be deposited by the transfer device 30 at the print station 6 between the cap 21 and the tip 22 of the holding and drive device 14, as may be seen in FIG. 4.

Figure 5:
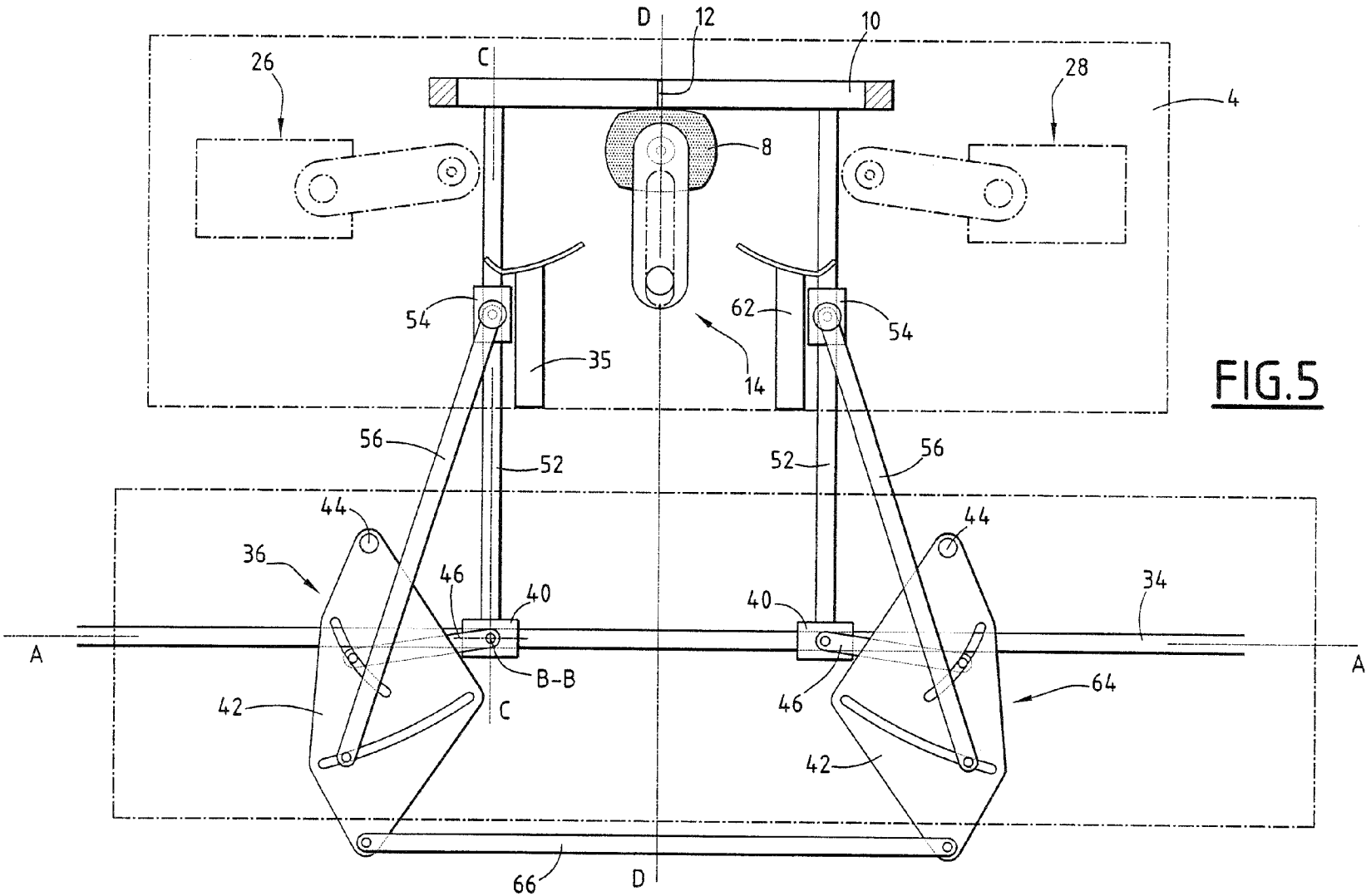
FIG. 5 is a view similar to the view of FIG. 1 in a position during printing of the item.

During a printing phase, the arms 16 and 18 are driven by the drive shaft 20 so as to rotate clockwise, as may be seen in FIG. 5.

At the same time, the screen 10 is displaced towards the discharge conveyor 28. The doctor blade 12 rests against the mesh of the screen 10. The ink is transferred by pressing the doctor blade 12 on to the item 8 to be printed.

At the same time, the drive plate 42 is driven so as to rotate clockwise until the supply bucket 35 is in the starting position for taking a new item to be printed at the supply conveyor 26 and, at the same time, the discharge bucket 62 is positioned adjacent to the cap 21 and to the tip 22 of the holding and drive device.

Figure 6:
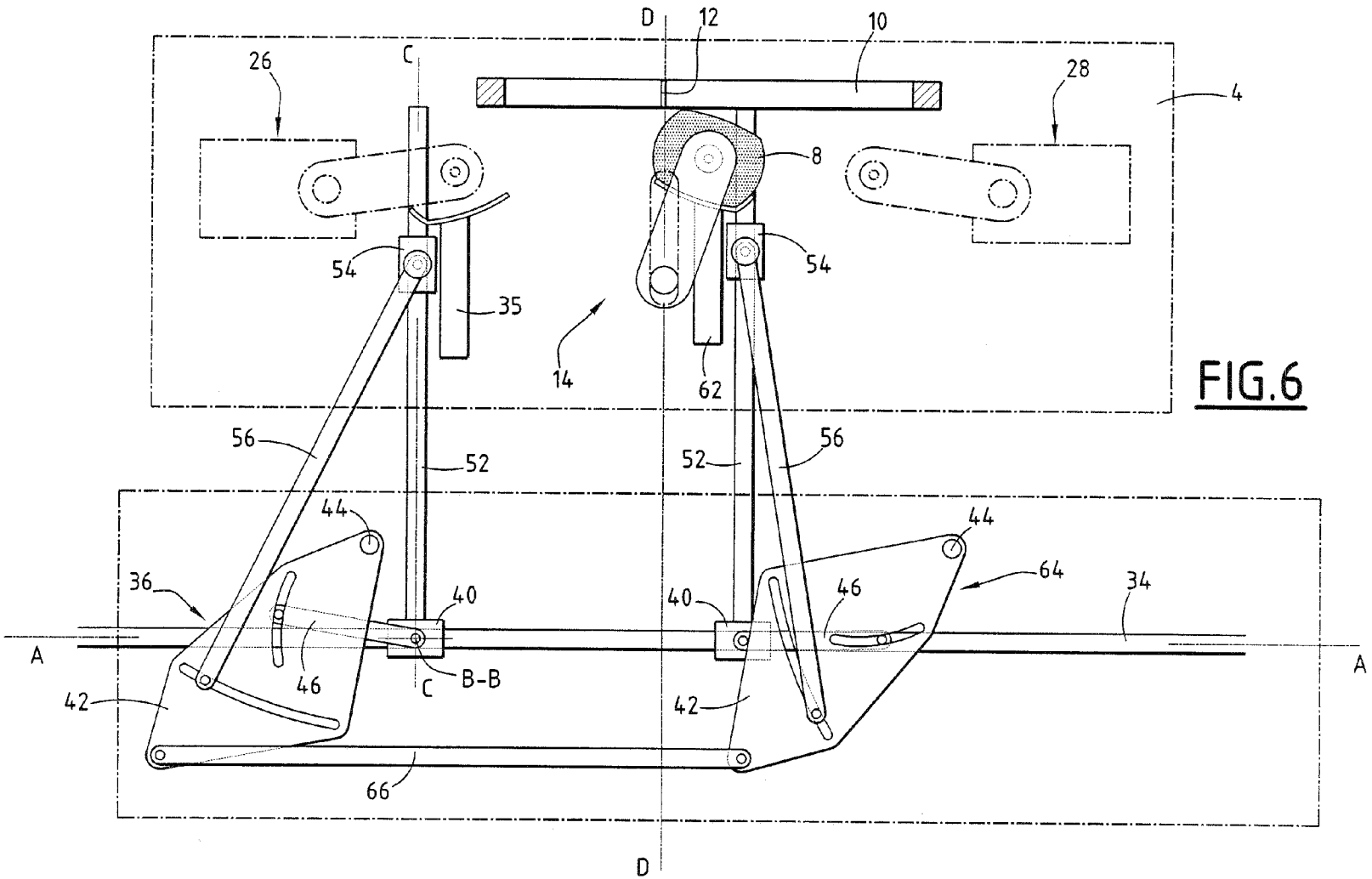
FIG. 6 is a view similar to the view of FIG. 1 in a position in which the transfer device takes up the item at the print station.

The discharge device 64 is then positioned in a position for taking up the item at the print station 6, as shown in FIG. 6.

During a second phase for transferring an item, the drive plates 42 of the supply device 36 and discharge device 64 are driven so as to rotate anticlockwise to supply the printed item 8 in line with the discharge conveyor 28 and to supply a second item to be printed (not shown) into a position for depositing the item at the print station.

During this phase, the doctor blade 12 is set apart from the screen 10.

The screen 10 is displaced towards the supply conveyor 26. The arms 16, 18 are driven so as to rotate anticlockwise in order to seek a second item to be printed transferred by the supply device 36.

Figure 8:
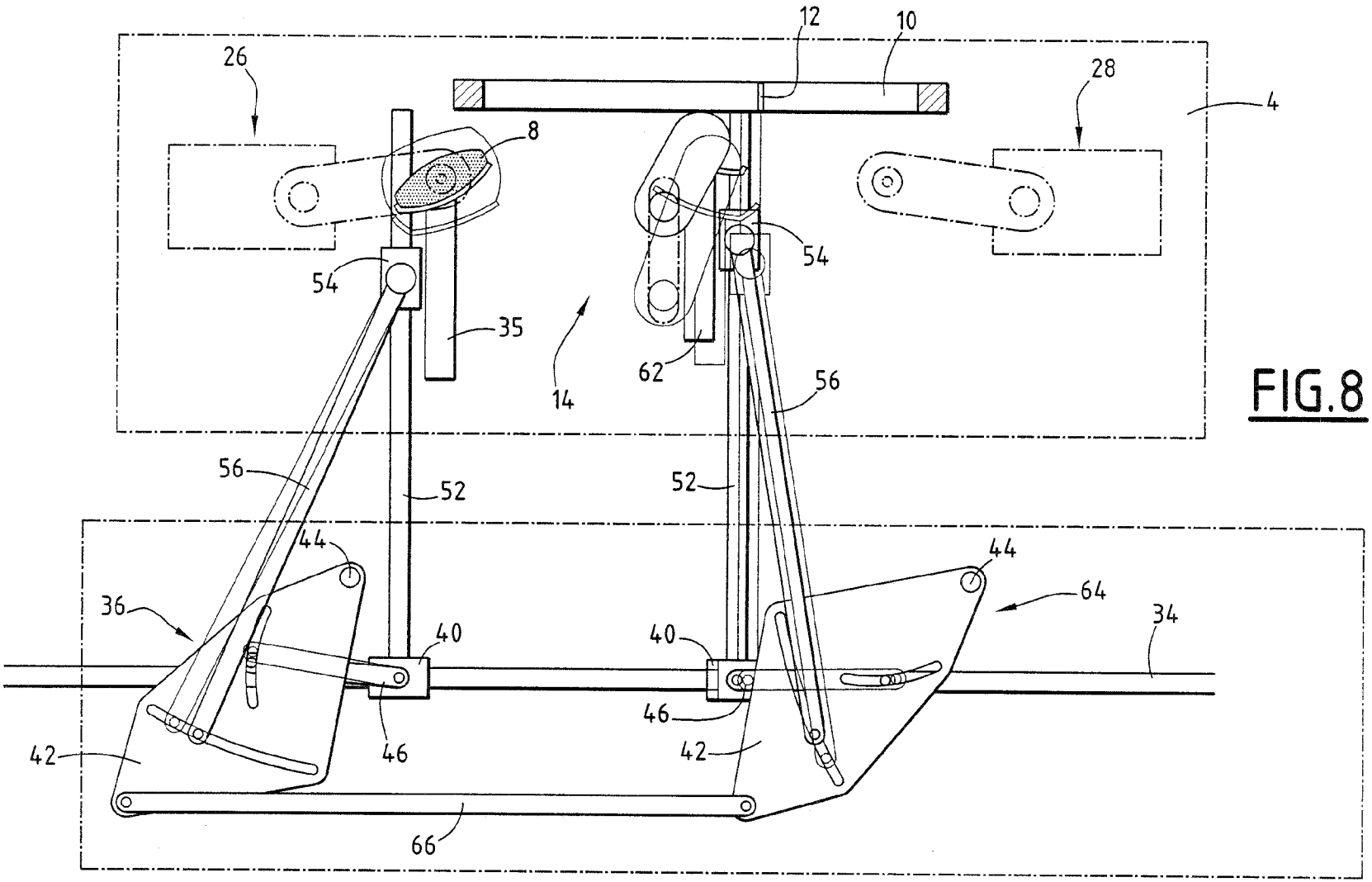
FIG. 8 is a view similar to the view of FIG. 1 showing two connecting rod positions.

If an elliptical item differing in size or shape has to be printed, the pivot roller 48 is displaced into the groove 50 in order to modify the position of the supply roller 35 along the first adjustment direction A-A into its position for depositing the item at the print station, as may be seen in FIGS. 1 and 8.

Thus, the initial angle for printing on the item 8 is adjusted to the elliptical shape of the item.

At the same time, the pivot roller 58 is displaced into the groove 60 to displace the supply bucket 35 along the second adjustment direction C-C into its position for depositing the item at the print station, as may be seen in FIGS. 1 and 8.

Thus, printing on the item 8 is adjusted as a function of the size of the item without the need to displace the screen 10 along a plane perpendicular to its large face.

Advantageously, if the take-up position of the pivot roller 48 is displaced into the groove 50, the position of the supply bucket 35 corresponding to the position for taking the item at the supply conveyor 26 is not displaced, as in this position the articulation 47 corresponds to the centre of the arc of a circle formed by the groove 50. Indeed, if the take-up position of the pivot roller 48 is displaced into the groove 50, merely the position of the supply bucket 35 corresponding to the position for depositing the item at the print station 6 is displaced, as is the path of displacement of the supply bucket 35 to arrive at the position for depositing the item at the print station 6.

Similarly, when the take-up position of the pivot roller 58 is displaced into the groove 60, the position of the supply bucket 35 corresponding to the position for taking up the item at the supply conveyor 26 is not displaced, as in this position the articulation 57 corresponds to the centre of the arc of a circle formed by the groove 60. There is therefore no need to displace the supply conveyor 26 when an elliptical item of differing shape has to be printed, as may be seen in FIG. 8 showing two positions of connecting rods 46, 48 and two corresponding positions of bucket 35 in dot-dash and solid lines.

Figure 9:
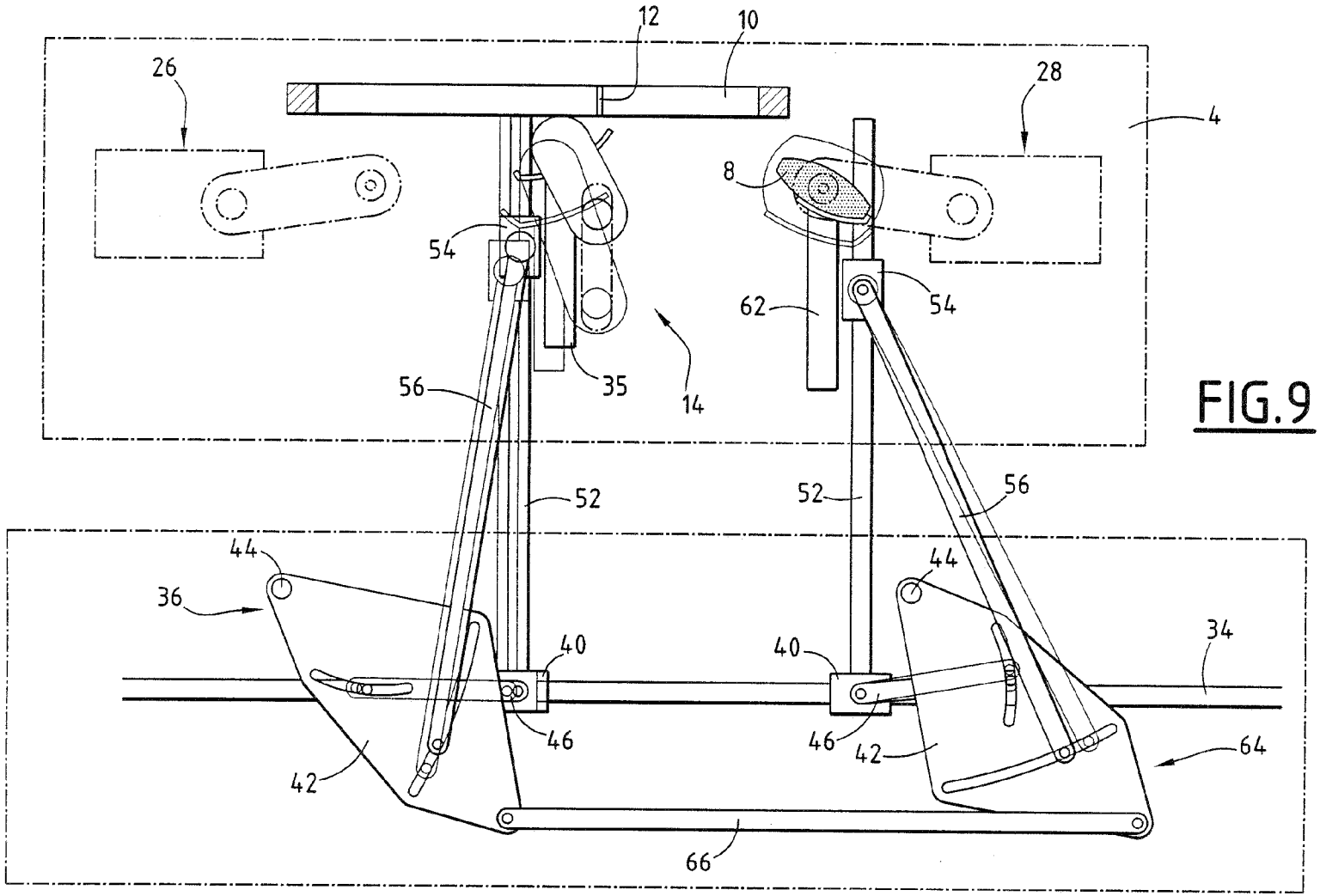
FIG. 9 is a view similar to the view of FIG. 7 showing two connecting rod positions.

Similarly, as the discharge device 64 is mounted symmetrically to the supply device 35, the position of the discharge bucket 62 corresponding to the position for depositing the item at the discharge conveyor 28 is not displaced when the pivot rollers 48 and 58 are displaced into the grooves 50 and 60 in the drive plate 42 of the device 35 when the discharge bucket 62 is in the position for depositing the item at the discharge conveyor, as may be seen in FIG. 9.

The position of the discharge bucket 62 corresponding to the position for taking up the item at the print station 6 is displaced when the pivot rollers 48 and 58 are displaced into the grooves 50 and 60 in the drive plate 42 of the device 64.

Advantageously, the orientation of the item is not modified during transfer of an item from the supply conveyor 26 to the print station 6 and from the print station 6 to the discharge conveyor 28.

The conveyors 26, 28 comprise each a position for taking up or deposing the item. This position is fixed in relation to the frame 4.

The pivot rollers 48 and 58 are fixed by any appropriate releasable means in a position over the length of the grooves 50 and 60 to fix the adjustment of the path of displacement of the conveyor buckets 35 and 62 as a function of the size of the item. When the pivot rollers 48 and 58 are fixed in the grooves 50 and 60, they are capable of pivoting about their axes but are no longer displaced within the grooves.

The connecting rods 52 and 56 each form a link.

Figure 10:
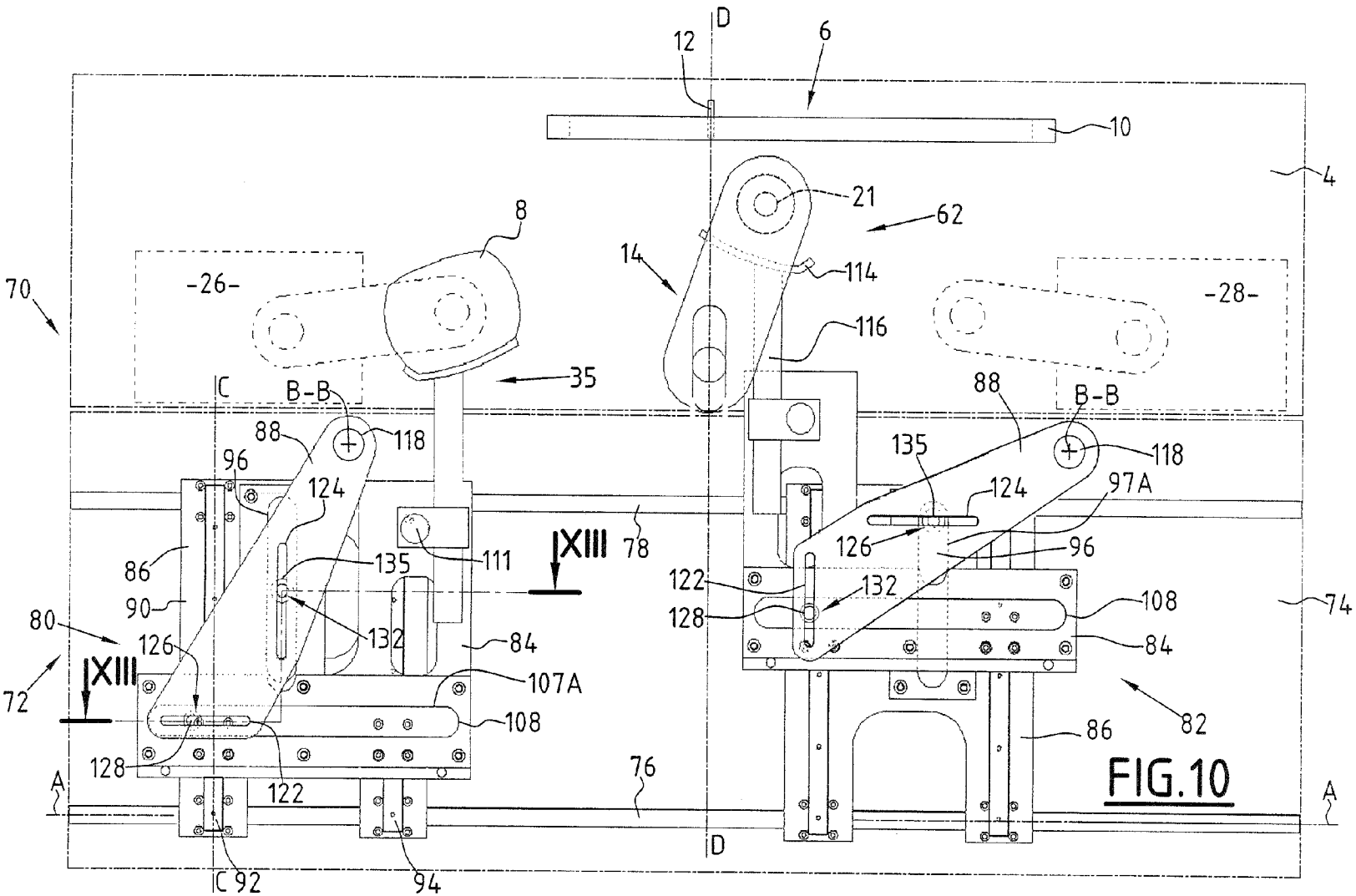
FIG. 10 is a schematic front view of a portion of the printing machine according to a second embodiment of the invention in a position for take-up of the item by the device for transferring the item to a supply conveyor.

The printing machine 70 according to the second embodiment is illustrated in FIG. 10.

The elements of the machine 70 according to the second embodiment that are identical to the elements of the machine 2 according to the first embodiment have been denoted by like reference numerals and will not be described a second time.

The printing machine 70 according to the second embodiment comprises a transfer device 72 instead of the transfer device 30 of the machine 2 according to the first embodiment.

The transfer device 72 comprises a base 74 which is illustrated schematically and fixed relative to the frame 4 and two rails 76, 78 fixed to the base 74. The rails 76 and 78 are set apart from and parallel to each other. They extend along an axis A-A in a plane parallel to the plane of displacement of the screen 10 and perpendicular to the front face of the printing machine. In the embodiment illustrated in the figures, the axis A-A extends horizontally.

The transfer device 72 comprises a device 80 for supplying the item 8 to be printed from the supply conveyor 26 to the print station 6 and a device 82 for discharging the item 8 to the discharge conveyor 28 after printing thereof.

The supply device 80 consists mainly of a first carriage 84 carrying a bucket 35 for supplying the item and a second carriage 86 mounted so as to slide over the rails 76, 78 and supporting the first carriage 84, and a drive plate 88 capable of driving in displacement the first carriage 84 and the second carriage 86.

The first carriage 84 and the rails 76, 78 form a first slide.

Figure 11:
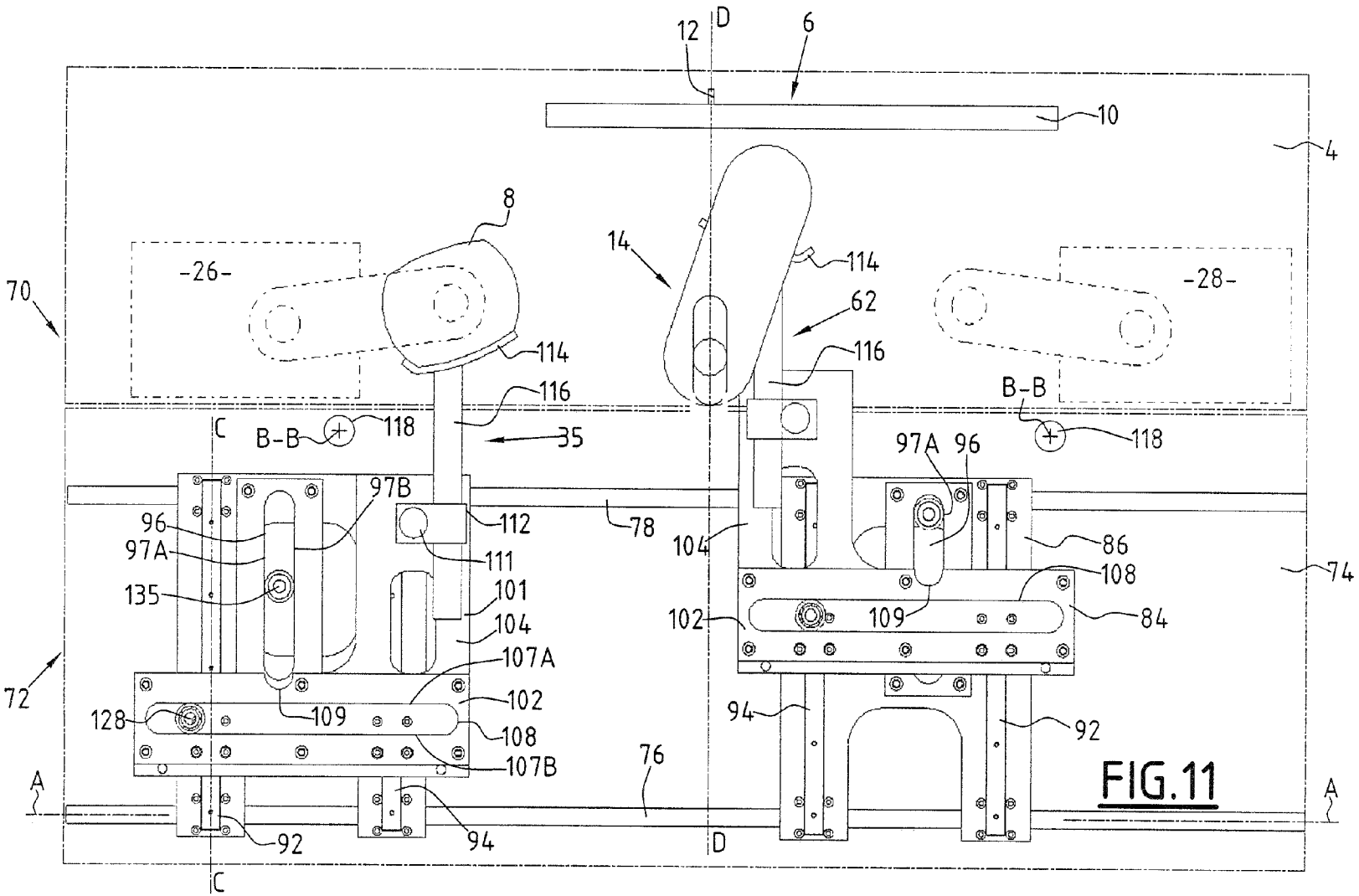
FIG. 11 is a view similar to the view of FIG. 10 in which the drive plates of the transfer device have been removed.
Figure 12:
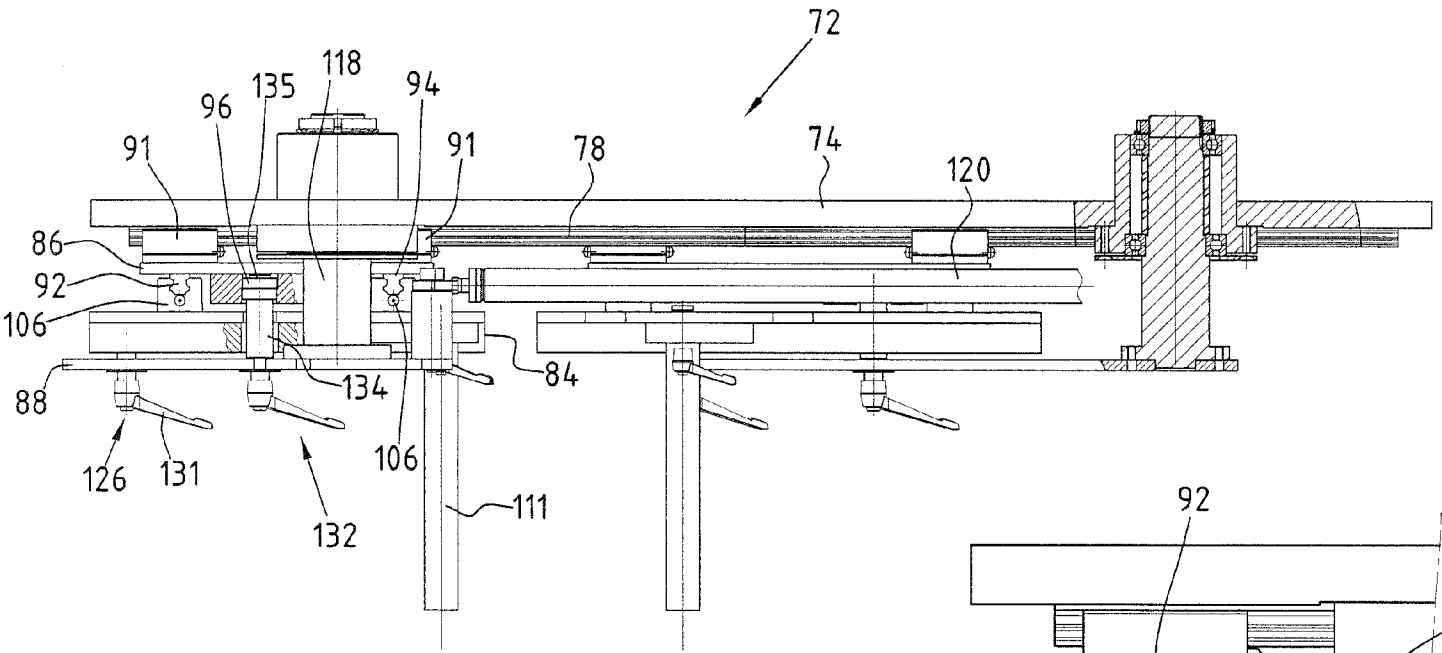
FIG. 12 is a partially cut-out view from above of the transfer device of the second embodiment of the invention.

The second carriage 86 shown in FIGS. 11 and 12 is formed from an H-shaped panel 90 equipped in one of its faces, referred to hereinafter as the rear face, with two pairs of pads 91 guided in translation in the horizontal rails 76, 78. It comprises on its opposing face, referred to as the front face, two rails 92, 94 for guiding the first carriage 84, which rails are set apart from each other and extend along an axis C-C perpendicular to the axis A-A. In the embodiment illustrated in the figures, the axis C-C extends vertically.

The second carriage 86 and the rails 92, 94 form a second slide.

The second carriage 86 further comprises on its front face a straight rectilinear cam track 96 parallel to the vertical axis C-C. The cam track 96 is formed from a rectilinear slot having two support faces 97A, 97B arranged facing each other and defined in a plane perpendicular to the front face of the frame 4.

The first carriage 84 consists of a reverse L-shaped panel 101, the lower branch 102 of which extends horizontally and the upper branch 104 of which extends vertically from the side of the print station 6.

The lower branch 102 is equipped, on its rear face, with a pair of pads 106 each guided in a vertical rail 92, 94 of the second carriage 86 and, on its front face, with a straight rectilinear cam track 108 parallel to the horizontal axis A-A.

The cam track 108 is formed from a rectilinear slot having two support faces 107A, 107B arranged facing each other and defined in a plane perpendicular to the front face of the frame 4.

A recess 109, the shape of which corresponds to the shape of the cam track 96, is formed in the lower branch 102 facing the cam track 96 to allow the passage of a link 126 from one end of the cam track 96 to the other, as explained in the remainder of the description.

A stud 111 for supporting a flange 112 for fixing the supply bucket 35 protrudes on the front face of the upper branch 104. The supply bucket 35 consists of a scoop 114 integral with the end of an upright 116. The upright 116 is mounted so as to slide and be lockable in position in the flange 112 in such a way that the distance between the scoop 114 and the flange 112 can be modified as a function of the size of the item to be printed.

The drive plate 88 is mounted so as to pivot about a shaft 118 fixed to the base 74 and extending along an axis B-B perpendicular to the axes A-A and C-C. It is driven in rotation through an angle of 90° by drive means (not shown).

Figure 14:
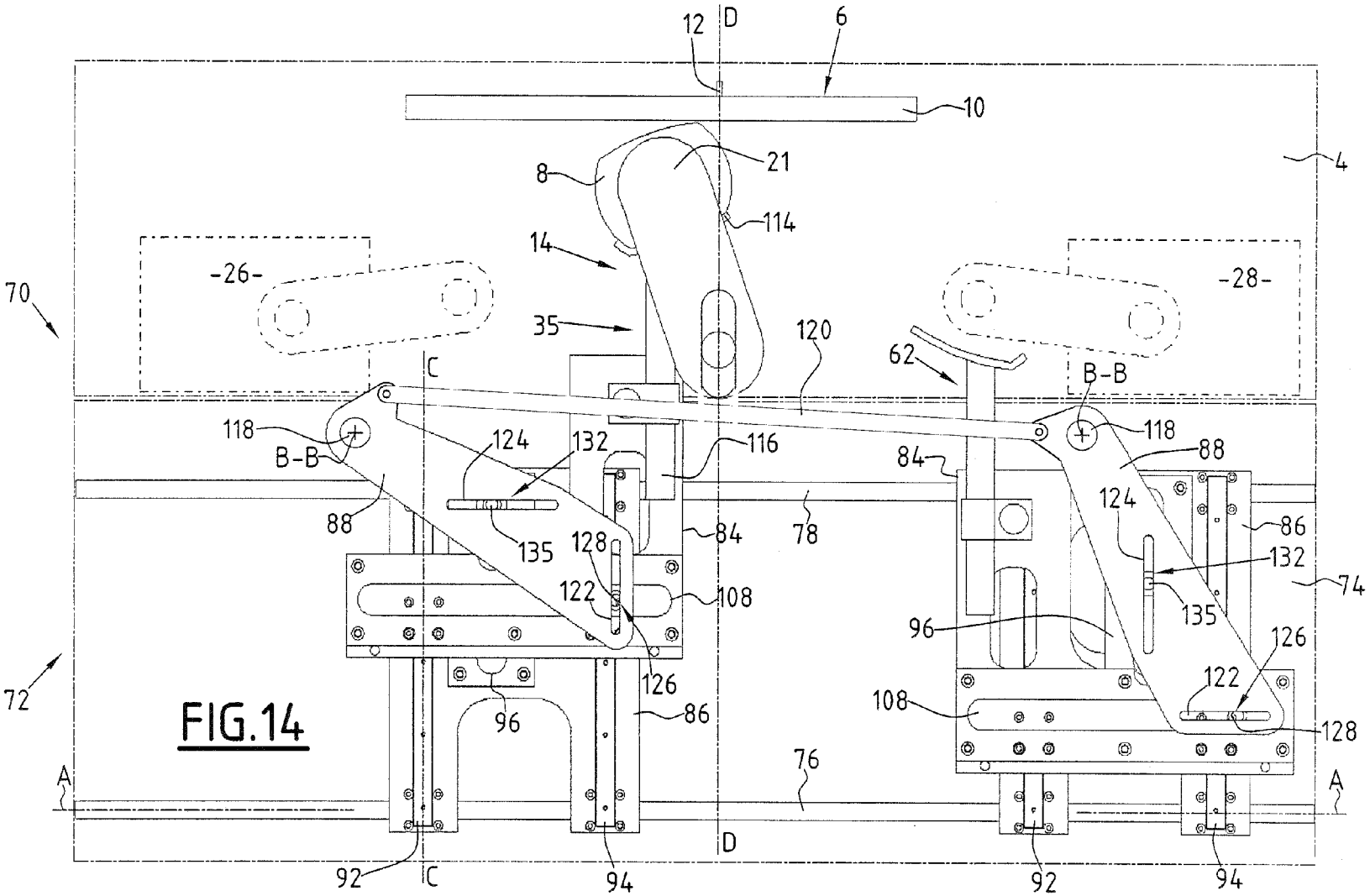
FIG. 14 is a view similar to the view of FIG. 10 in a position in which the transfer device deposits the item at the print station.

A synchronisation bar 120, shown merely in FIGS. 12 and 14, connects the drive plate 88 of the supply device 80 to the drive plate 88 of the discharge device 82 to synchronise the movements between these two devices.

The drive plate 88 comprises a first straight rectilinear groove 122 and a second straight rectilinear groove 124 perpendicular to the first groove.

The grooves 122 and 124 are formed by slots passing through the plate.

The first groove 122 extends parallel to the horizontal axis A-A when the drive plate 88 is at one end of its trajectory, referred to hereinafter as the far end, and extends parallel to the vertical axis C-C when the drive plate 88 is at the other end of its trajectory, referred to hereinafter as the near end. The far end position of the drive plate 88 is the position occupied by the supply device 80 in FIG. 10. This position corresponds to the position for taking up or depositing the item 8 at the supply conveyor 26 or at the discharge conveyor 28. The near end position is the position occupied by the discharge device 82 in FIG. 10. This position corresponds to the position for depositing or taking up the item at the print station 6.

The first groove 122 has a length L1 less than the length of the cam track 108. The first groove 122 is arranged in its entirety so as to face the cam track 108 when the drive plate 88 is at the far end. The first groove 122 is arranged perpendicularly to the cam track 108 when the drive plate is at the near end. In this position, the first groove 122 extends perpendicularly to the cam track 108 and intercepts therewith.

Figure 13:
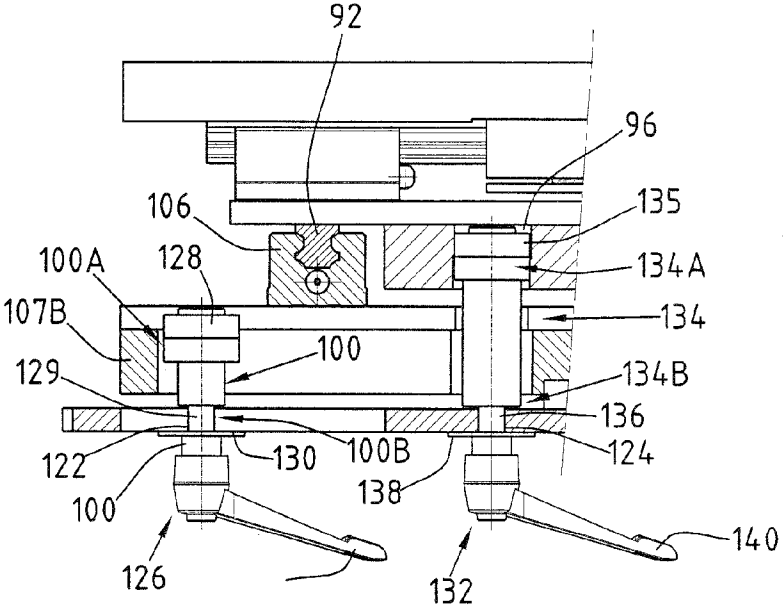
FIG. 13 is a cross-section of the transfer device along the plane XIII-XIII of FIG. 10.

The drive plate 88 is coupled to the first carriage 84 via a link 126 which may be seen in FIGS. 12 and 13. Said link comprises a rod 100 equipped, at one of its ends 100A, with a roller 128 guided in the cam track 108 and, at its other end 100B, with a bearing 129 and with fixing means 130 controlled by an adjustment lever 131 extending so as to protrude relative to the drive plate 88. The roller 128 and the cam track 108 formed a sliding connection.

The bearing 129 has an axis of rotation parallel to the axis B-B. It passes through the first groove 122.

The fixing means 130 have a shoulder capable of being fixed to the front face of the drive plate 88 by cleats for fixing the link 126 at a point in the first groove 122.

The end 100B of the link passes through the groove 122 and is capable of being displaced along said groove during a phase of adjustment of the drive means and of being fixed in a position defined as a function of the chosen position for take-up or depositing at the print station, this last position being determined as a function of the size and shape of the item 8.

The link 126 is held immobilised at this point relative to the drive plate 88 by the fixing means 130.

The second groove 124 has a length L2 less than the length of the cam track 96.

The drive plate 88 is coupled to the second carriage 86 by a link 132 similar to the link 126. In particular, it comprises rod 134 equipped, at one of its ends 134A, with a roller 135 engaged in the cam track 96 of the second carriage and, at its other end 134B, with a bearing 136 and fixing means 138 controlled by an adjustment lever 140. The roller 135 and the cam track 96 form a sliding connection.

The fixing means 138 are identical to the fixing means 130. The end 134B of the link 132 passes through the groove 124 at a position defined as a function of the chosen position for take-up or depositing at the print station. The link 132 is held in this position of the second groove 124 relative to the drive plate 88 by the fixing means 138.

The bearings 129, 136 and the grooves 122, 124 form means for adjusting the trajectory of displacement of the conveyor buckets 35, 62, as specified in the remainder of the description.

For the sake of clarity, the bearings 129, 136 and the adjustment levers 131, 140 have not been illustrated in FIGS. 10, 11 and 14 to 17.

The discharge device 82 comprises elements similar to those of the supply device 80, which elements are mounted symmetrically relative to a median plane D-D perpendicular to the plane of the front face of the frame 4.

During an initial phase illustrated in FIG. 10, the supply device 80 is in a position for taking up the item on the supply conveyor 26. The drive plate 88 of the supply device 80 is then at the far end.

In this position, the first groove 122 and second groove 124 in the drive plate 88 are parallel to the cam track 108 and to the cam track 96 respectively.

The discharge device 82 is in a position for taking up the printed item at the print station 6. The drive plate 88 of the discharge device 82 is at the near end.

The drive plate 88 of the discharge device 82 is out of phase by an angle of 90° relative to the drive plate 88 of the supply device 80 in such a way that, in contrast to the supply device, the first groove 122 and the second groove 124 in the drive plate 88 of the discharge device 82 extend perpendicularly to the cam track 108 and the cam track 96 respectively.

Then, during operation, the drive plates 88 of the devices 80, 82, driven by drive means (not shown), pivot anticlockwise about the shaft 118.

In the supply device 80, the roller 135, driven by the link 132 fixed to the plate 88, is displaced over a portion of the cam track 96 and rests against the face 97B of the cam track arranged on the side of the print station, thus driving the second carriage 86 along the axis A-A towards the print station 6. At the same time, the roller 128, driven by the link 126 fixed to the plate 88, is displaced over a portion of the cam track 108 and rests against the upper face 107A of the cam track 108 to drive the first carriage 84 which is displaced over the vertical rails 92, 94 towards the screen 10.

In the discharge device 82, the roller 135 rests against the face 97A of the cam track 96 and drives the second carriage 86 towards the discharge conveyor 28. At the same time, the roller 128 of the discharge device 82 rests against the face 107B of the cam track 108 and drives the first carriage 84 in a direction opposing that of the print station 6.

Once the drive plates have pivoted through an angle of 90°, the supply device 80 is in a position, illustrated in FIG. 14, for depositing the item 8 at the print station 6. This position corresponds to the position of the discharge device during the initial phase illustrated in FIG. 10.

The discharge device 82, for its part, is in a position for depositing the item at the discharge conveyor 28. This position corresponds to the position of the supply device 80 during the initial phase illustrated in FIG. 10.

During these movements, the links 126, 132, made integral with the plate 88 by the fixing means 130, 138, are not displaced into the first groove 122 and second groove 124.

The item 8 to be printed is deposited by the supply bucket 35 at the print station 6 between the cap 21 and the tip 22 of the holding and drive device 14.

Figure 15:
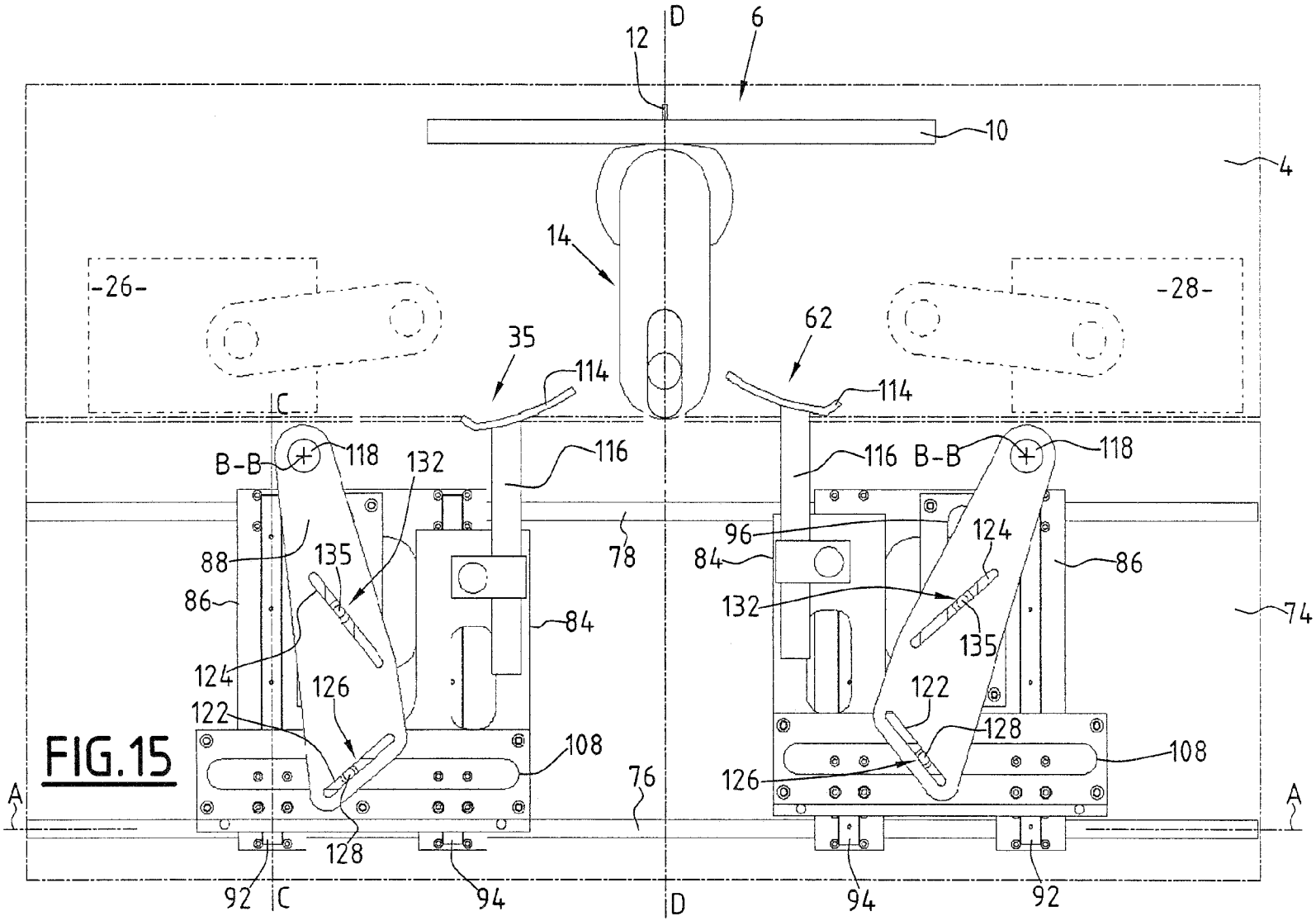
FIG. 15 is a view similar to the view of FIG. 10 in a position during printing of the item.

The printing phase illustrated in FIG. 15 is then carried out in the same way as the printing phase carried out by the printing machine 2 according to the first embodiment of the invention.

Figure 16:
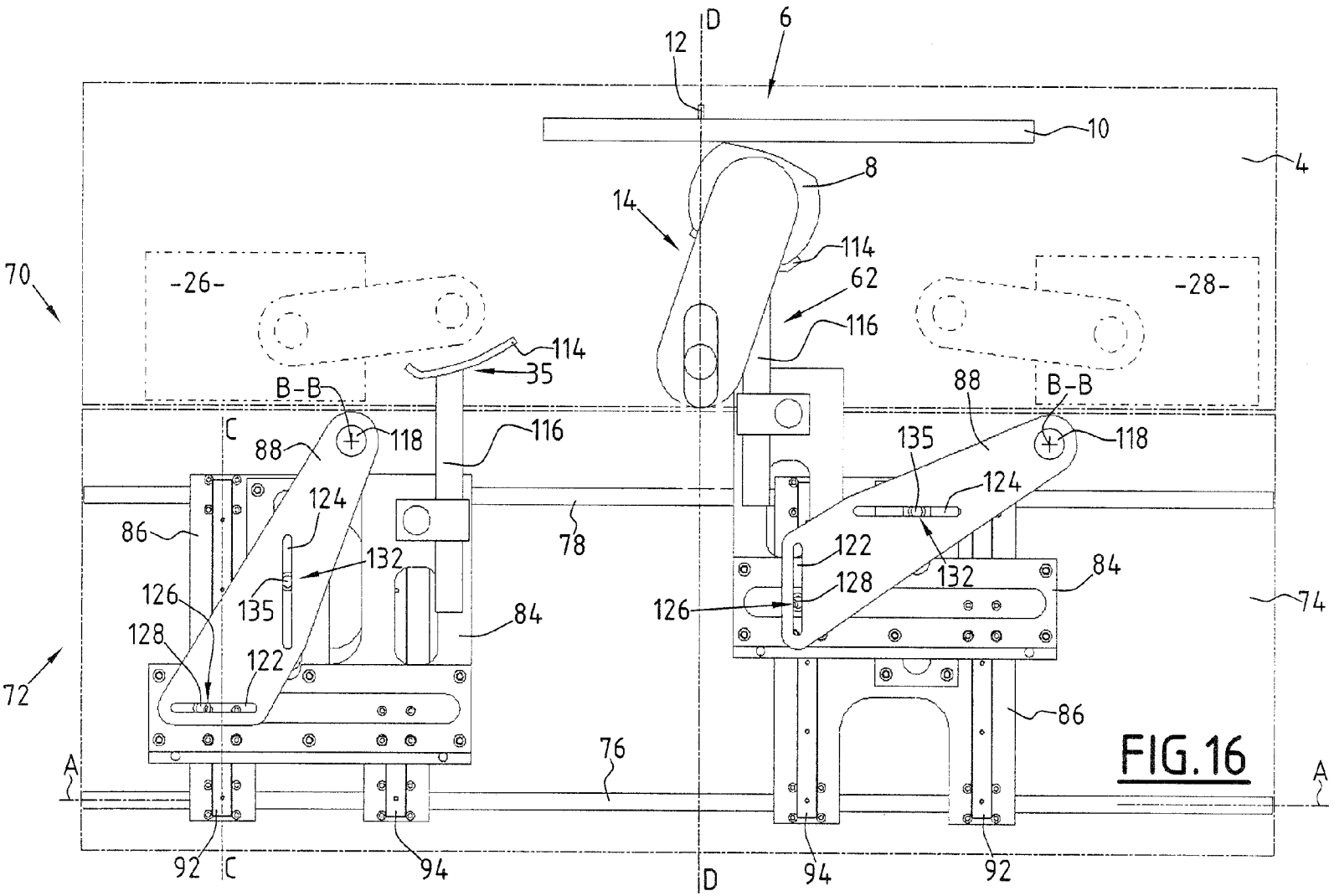
FIG. 16 is a view similar to the view of FIG. 10 in a position in which the transfer device takes up the item at the print station.

During printing, the drive plates 88 are driven clockwise in rotation through an angle of 90° until the supply bucket 35 is in the starting position for taking up a new item to be printed at the supply conveyor 26 and, at the same time, the discharge bucket 62 is positioned adjacent to the holding and drive device 14, as illustrated in FIG. 16.

The displacement phases illustrated in FIG. 10 to 16 are resumed for conveying a new item to the print station 6 and for conveying the printed item to the discharge conveyor 28.

When an item of differing size has to be printed, the supply device 80 is adjusted in such a way that the position for taking up the item at the item conveyor 26 is not modified relative to the frame 4; instead, the position for depositing the item at the print station 6 is modified relative to the frame 4, the new depositing position being adapted to the size of the new item. At the same time, the discharge device 82 is adjusted in a similar manner, so the position for taking up the new item at the print station 6 is modified without modification of the position for depositing the item at the discharge conveyor 28. There is thus no need to displace the conveyors 26 and 28 and the mounting and printing devices preceding or following them each time an item of differing size has to be printed.

Figure 17:
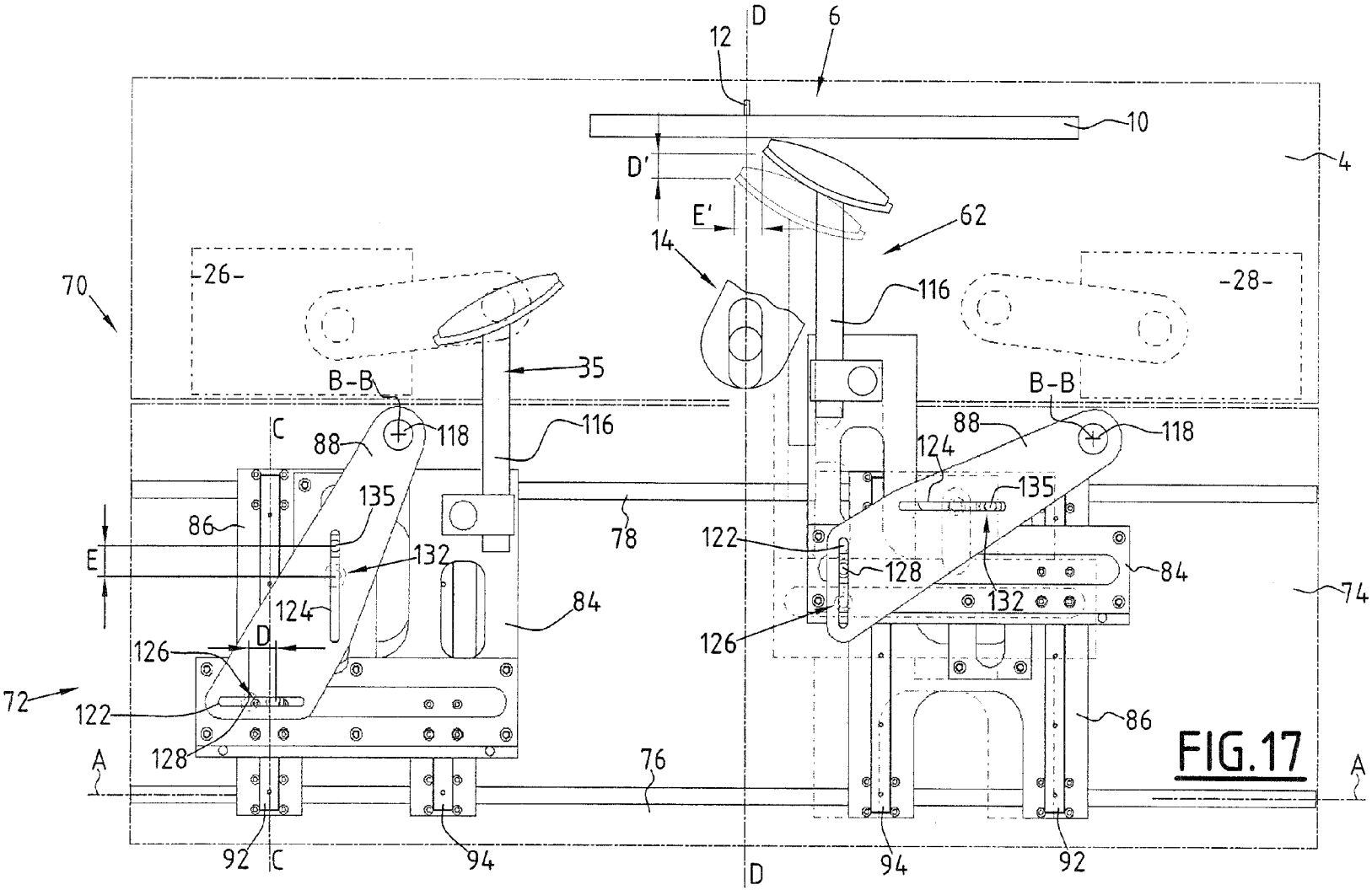
FIG. 17 is a view similar to the view of FIG. 10 showing two positions of the transfer device corresponding to two differing positions of the adjustment means.

FIG. 17 shows, in solid lines, the transfer device 72 adjusted in the same way as in FIG. 10 to 16 and, in dot-dash lines, this same transfer device 72 adjusted in a different manner for conveying a smaller item.

In FIG. 17, the supply device 80 and the discharge device 82 have been adjusted in the same way, so the take-up depositing position of the supply device 80 at the conveyor 26 is identical to the take-up/depositing position of the discharge device 82 at the conveyor 28 and the take-up/depositing position of the supply device 80 at the print station 6 is identical to the take-up/depositing position of the discharge device 82 at the print station.

To adjust the drive means of the transfer device 72, the operator displaces, using the lever 131, the link 126 into the first groove 122 by a distance D in the direction of the axis A-A relative to the preceding position of the link 126 (in solid lines in FIG. 17).

Using the lever 140, the operator also displaces the link 132 into the second groove 124 by a distance E in the direction of the axis C-C relative to the preceding position of the link 132.

Moreover, the upright 116 is displaced in the flange 112 to adapt the transfer device 72 to the size of the new item.

As the grooves 122 and 124 extend parallel to the cam tracks 96 and 108 when the devices are in the position for taking up or depositing an item at the conveyor 26 and 28 (cf. the position of the supply device 80 in FIG. 17), the displacement of the links 126 and 132 does not modify the position of the first carriage 84 and the second carriage 86 relative to the position of the drive plate 88 and therefore the position of the supply bucket 35, when in the position for taking up the item at the conveyor 26, and also the position of the discharge bucket 62 when in the position for depositing the item at the conveyor 28.

Conversely, as the grooves 122 and 124 are perpendicular to the cam tracks 96 and 108 when the devices are arranged in a position for take-up or depositing at the print station 6, the displacement of the links 126 and 132 causes displacement of the first carriage 84 and the second carriage 86 relative to the drive plate 88 and therefore of the discharge bucket 62 carried by the first carriage 84, as may be seen in FIG. 17 in which the discharge device 82 is illustrated in dot-dash lines and in solid lines in two differing adjustment positions.

The distance D' is the distance separating the preceding position (in solid lines) for taking up the item at the print station from the new position (in dot-dash lines) for taking up the item at the print station after displacement of the link 126 by a distance D in the groove 122. The distance D' is equal to the distance D.

Similarly, the distance E' is the distance separating the preceding position (in solid lines) for taking up the item at the print station 6 along the axis C-C from the new position (in dot-dash lines) for taking up this item at the print station after displacement of the link 132 in the groove 124 by a distance E. The distance E' is equal to the distance E.

Thus, the position for taking up or depositing the item at the print station 6 can be displaced in a rectangular surface, the height of which is equal to the length L1 of the groove 122 and the width of which is equal to the length L2 of the groove 124. The cam tracks 96 and 98 have a length greater than the sweeping length of the rollers 135 and 128, as the length of these cam tracks allows for the various possible positions of the links 126 and 132 inside the grooves 122 and 124 and of the back-and-forth movement of the rollers 128 and 135 in the cam tracks 108, 96 during the phases of displacement of the carriages 84, 86.

The invention claimed is:

1. Printing machine comprising:

a frame;

at least one conveyor capable of conveying at least one item to be printed;

at least one print station fixed relative to the frame and capable of printing a pattern on the item to be printed; and at least one transfer device comprising a base fixed relative to the frame and comprising at least one bucket for conveying the item to be printed and means for driving the conveyor bucket, which means are capable of displacing said conveyor bucket between a position for taking up or depositing the item on the conveyor and a position for taking up or depositing the item at the print station;

wherein the transfer device further comprises means for adjusting the path of displacement of the conveyor bucket, which means are capable of adjusting the drive means in order to displace the position for taking up or depositing the item on the print station without displacing the position for taking up or depositing the item on the conveyor.

2. Printing machine according to claim 1, wherein the drive means comprise:

a drive plate capable of being driven in rotation;

a slide capable of displacing the conveyor bucket relative to the base; and a link for coupling the drive plate to the slide, said link being displaceable relative to the drive plate.

3. Printing machine according to claim 2, wherein the drive plate is capable of being driven in rotation about a shaft fixed relative to the base and wherein the adjustment means are capable of modifying the distance between the shaft and the link to adjust the path of displacement of the conveyor bucket.

4. Printing machine according to claim 2, wherein the adjustment means are capable of allowing uncoupling of the slide relative to the drive plate during displacement of the coupling link relative to the plate along a unique predefined trajectory and only when the conveyor bucket is in the position for taking up or depositing the item on the conveyor.

5. Printing machine according to claim 2, wherein the adjustment means comprise an adjustment groove integral with the drive plate and wherein the coupling link comprises:

a first end engaged with the adjustment groove, said first end of the link being capable of being displaced along the adjustment groove and of being immobilised at a point of the adjustment groove to adjust the path of displacement of the conveyor bucket; and a second end carried by the slide, the second end being capable of being displaced relative to the slide during displacement of the first end of the link along the adjustment groove without displacement of the conveyor bucket when the conveyor bucket is in the position for taking up or depositing the item on the conveyor.

6. Printing machine according to claim 5, wherein the adjustment groove is rectilinear.

7. Printing machine according to claim 5, wherein the coupling link comprises a sliding connection between the slide and the drive plate, said sliding connection extending parallel to the adjustment groove when the conveyor bucket is in the position for taking up or depositing the item on the conveyor.

8. Printing machine according to claim 7, wherein said sliding connection extends perpendicularly to the adjustment groove when the conveyor bucket is in the position for taking up or depositing the item on the print station.

9. Printing machine according to claim 7 taken in combination, wherein the sliding connection comprises a cam track integral with the slide and a roller capable of sliding in said cam track, the shaft of the roller being connected to an end of the coupling link.

10. Printing machine according to claim 9, wherein the drive plate is capable of driving the slide by pressing the roller against a support face of the cam track, the link being displaced in the cam track during displacement of the drive plate.

11. Printing machine according to claim 2, wherein:

the slide comprises a first slide extending along a first axis and a second slide extending along a second axis perpendicular to the first axis;

the coupling link comprises a first link for coupling the drive plate to the first slide and a second link for coupling the drive plate to the second slide, the second coupling link being identical to the first coupling link; and wherein the adjustment means comprise a first adjustment groove and a second adjustment groove formed in the drive plate.

12. Printing machine according to claim 11, wherein the first adjustment groove extends along the first axis when the conveyor bucket is in the position for taking up or depositing the item on the print station and along the second axis when the conveyor bucket is in the position for taking up or depositing the item on the conveyor.

13. Printing machine according to claim 11, wherein the second adjustment groove is perpendicular to the first adjustment groove.

14. Printing machine according to claim 11, wherein the second slide comprises at least one rail mounted so as to be fixed relative to the base, the rail being parallel to the second axis A-A, and a second carriage capable of sliding over the or each fixed rail.

15. Printing machine according to claim 14, wherein the first slide comprises at least one movable rail which is integral with the second carriage, the or each movable rail extending along the first axis, and a first carriage guided on the movable rail.

16. Printing machine according to claim 5, wherein the adjustment groove extends in an arc of a circle and wherein the second end of the link comprises a pivot which is centred on the adjustment groove when the conveyor bucket is in the position for taking up or depositing the item on the conveyor.

17. Printing machine according to claim 1, wherein the drive means comprise a linkage having an adjustable configuration comprising at least four articulation points and wherein the adjustment means are capable of displacing at least a first articulation point of the linkage, the first articulation point being capable of being displaced, in order to produce said adjustment, along an arc of a circle centred on a second articulation point only in the position for taking or depositing the item on the conveyor.

18. Printing machine according to claim 17, wherein the linkage comprises at least a first connecting rod connected to the drive plate; and wherein the adjustment means comprise at least a first means for articulating an end of the first connecting rod to a slideway of the drive plate, which means is capable of adjusting the path of displacement of the conveyor bucket in a first adjustment direction.

19. Printing machine according to claim 18, wherein the first articulation means is adjustable in the position for taking up or depositing the item on the conveyor whereas the conveyor bucket is not displaced during this adjustment.

20. Printing machine according to claim 18, wherein the first articulation means comprises:

a first groove in the form of an arc of a circle centred on said second articulation point when the transfer device is in a position for taking up or depositing the item at the conveyor and a first roller capable of being guided in the first groove.

21. Printing machine according to claim 17, wherein the linkage further comprises a second connecting rod connected to the drive plate; and wherein the adjustment means comprise a second means for articulating an end of the second connecting rod to a slideway of the drive plate, which means is capable of adjusting the path of displacement of the conveyor bucket in a second adjustment direction differing from said first adjustment direction.

22. Printing machine according to claim 19, wherein said second adjustment direction is perpendicular to the first adjustment direction.

23. Printing machine according to claim 19, wherein the second articulation means is adjustable in the position for taking up or depositing the item at the transporter whereas the conveyor bucket is not displaced during this adjustment.

24. Printing machine according to claim 20, wherein the second articulation means comprises:

a second groove in the form of an arc of a circle centred on the second articulation point when the transfer device is in a position for taking up or depositing the item at the conveyor and a second roller capable of being guided in the second groove.

25. Printing machine according to claim 17, wherein the linkage forms a quadrilateral comprising at least a first side, the length of which can be adjusted by said adjustment means.

26. Printing machine according to claim 25, wherein the quadrilateral comprises at least second side, the length of which can be adjusted by said adjustment means.

27. Printing machine according to claim 24, wherein the quadrilateral comprises at least second side, the length of which can be adjusted by said adjustment means, and wherein a first apex of the quadrilateral comprises a first slide guided on a first rail fixed relative to the frame and extending in first adjustment direction.

28. Printing machine according to claim 22, wherein the quadrilateral comprises at least second side, the length of which can be adjusted by said adjustment means, and wherein a second apex of the quadrilateral comprises a second slide which carries the conveyor bucket and is capable of being guided in a movable rail integral with the first slide and extending in said second adjustment direction.

29. Printing machine according to claim 1, wherein the conveyor is a conveyor for conveying at least one item to be printed, the conveyor bucket being a bucket for supplying the item to be printed, the drive means being means for driving the supply bucket, which means are capable of displacing said supply bucket between a position for taking up the item on the supply conveyor and a position for depositing the item at the print station, the adjustment means being means for adjusting the path of displacement of the supply bucket;

and wherein the machine further comprises a conveyor for discharging the item after printing;

and wherein the transfer device further comprises:

a bucket for discharging the printed item;

means for driving the discharge bucket, which means are capable of displacing said discharge bucket between a position for taking up the printed item at the print station and a position for depositing the printed item on the discharge conveyor;

means for adjusting the path of displacement of the discharge bucket:

and wherein the means for adjusting the path of the supply bucket and the means for adjusting the path of the discharge bucket are independent of one another.

30. Printing machine according to claim 25, wherein the means for driving the supply bucket and the means for driving the discharge bucket are arranged symmetrically relative to a median plane intersecting the print station.

31. Printing machine according to claim 29, wherein the transfer device comprises synchronisation means capable of synchronising the displacement of the supply bucket and the displacement of the discharge bucket.

* * * * *